US008141623B2

(12) United States Patent
Blecker

(10) Patent No.: US 8,141,623 B2
(45) Date of Patent: Mar. 27, 2012

(54) AUTOMATIC SWITCHING TWO PIPE HYDRONIC SYSTEM

(76) Inventor: Joseph G. Blecker, Laguna Niguel, CA (US)

( * ) Notice: Subject to any disclaimer, the term of this patent is extended or adjusted under 35 U.S.C. 154(b) by 1213 days.

(21) Appl. No.: 11/743,069

(22) Filed: May 1, 2007

(65) Prior Publication Data

US 2008/0271881 A1 Nov. 6, 2008

(51) Int. Cl.
*F25B 29/00* (2006.01)

(52) U.S. Cl. ..... 165/219; 165/48.1; 165/50; 165/63; 165/64; 165/218; 62/201; 62/434; 62/435; 237/8 R; 237/59; 237/61; 237/62; 237/63

(58) Field of Classification Search ..... 165/50, 165/219, 218, 48.1, 63, 64; 62/435, 434, 62/201; 237/8 R, 59, 61, 62, 63
See application file for complete search history.

(56) References Cited

U.S. PATENT DOCUMENTS

| | | | | | |
|---|---|---|---|---|---|
| 1,838,260 | A | * | 12/1931 | Jacob | 165/50 |
| 2,492,757 | A | * | 12/1949 | Meck | 237/8 R |
| 2,500,695 | A | * | 3/1950 | McGrath | 165/50 |
| 2,500,696 | A | * | 3/1950 | McGrath | 165/50 |
| 2,588,723 | A | * | 3/1952 | Herman | 165/50 |
| 2,715,514 | A | * | 8/1955 | Stair | 165/50 |
| 2,797,068 | A | * | 6/1957 | McFarlan | 165/50 |
| 2,930,593 | A | * | 3/1960 | Blum | 165/220 |
| 3,384,155 | A | * | 5/1968 | Newton | 165/219 |
| 3,425,485 | A | * | 2/1969 | Newton | 165/218 |
| 3,853,172 | A | | 12/1974 | McFarlan | |
| 3,891,817 | A | | 6/1975 | Brown | |
| 3,926,008 | A | | 12/1975 | Webber | |
| 3,964,676 | A | | 6/1976 | Rooks et al. | |
| 3,993,120 | A | | 11/1976 | Iberg et al. | |
| 4,018,265 | A | | 4/1977 | Schluter | |
| 4,019,569 | A | | 4/1977 | McMann et al. | |
| 4,034,801 | A | | 7/1977 | Bernstein | |
| 4,098,092 | A | | 7/1978 | Singh | |
| 4,124,998 | A | | 11/1978 | Swiderski | |
| 4,158,291 | A | | 6/1979 | Jones | |
| 4,171,622 | A | | 10/1979 | Yamaguchi et al. | |
| 4,279,381 | A | | 7/1981 | Yueh | |
| 4,313,307 | A | | 2/1982 | Sisk | |
| 4,313,314 | A | | 2/1982 | Boyanich | |
| 4,363,441 | A | | 12/1982 | Feinberg | |
| 4,545,524 | A | | 10/1985 | Zelczer | |
| 4,600,144 | A | | 7/1986 | Zelczer | |
| 4,685,617 | A | | 8/1987 | Assaf | |
| 4,687,133 | A | | 8/1987 | Karlstedt | |
| 4,707,995 | A | | 11/1987 | Assaf | |
| 4,742,956 | A | | 5/1988 | Zelczer | |

(Continued)

*Primary Examiner* — John Ford
(74) *Attorney, Agent, or Firm* — Aidenbaum Schloff and Bloom PLLC; Jay Schloff

(57) ABSTRACT

Disclosed is an automatic switching two pipe hydronic system for conditioning a space. In one embodiment the two pipe hydronic system enables automatic switching from a first mode of operation to a second mode of operation or vice versa in a reduced span of time. The present invention saves fuel, energy and water, when there are lower load conditions that affect boilers, chillers, and cooling towers. In another embodiment, the present invention provides a system for simultaneously heating and cooling a first portion and a second portion of a space by utilizing a plurality of boilers, chillers, heat exchangers, condenser pumps and closed loop pumps by using a plurality of sensors indicating the temperatures inside and outside the space and a controlling module controlling the operation of the system. The present invention can be easily achieved by making minor configurational modifications to existing systems thereby increases system versatility.

6 Claims, 13 Drawing Sheets

U.S. PATENT DOCUMENTS

| | | | |
|---|---|---|---|
| 4,747,273 | A | 5/1988 | Cook et al. |
| 4,760,955 | A | 8/1988 | Turner |
| 4,775,944 | A | 10/1988 | Nakamura |
| 4,909,308 | A | 3/1990 | Dreibelbis et al. |
| 4,916,642 | A | 4/1990 | Kaiser et al. |
| 5,211,713 | A | 5/1993 | Suyama |
| 5,299,278 | A | 3/1994 | Heller |
| 5,332,028 | A | 7/1994 | Marris |
| 5,369,597 | A | 11/1994 | Bujak, Jr. |
| 5,924,486 | A | 7/1999 | Ehlers et al. |
| 6,216,956 | B1 | 4/2001 | Ehlers et al. |
| 6,470,837 | B2 | 10/2002 | Kayahara |
| 6,575,233 | B1 | 6/2003 | Krumnow |
| 6,644,398 | B2 | 11/2003 | Bujak, Jr. |
| 6,725,914 | B2 | 4/2004 | Petterson |
| 6,981,651 | B2 | 1/2006 | Robertson |
| 6,983,788 | B2 | 1/2006 | Haglid |
| 2001/0048032 | A1 | 12/2001 | Macintyre |
| 2002/0082747 | A1 | 6/2002 | Kramer |
| 2002/0084337 | A1 | 7/2002 | Bauer |
| 2004/0262412 | A1 | 12/2004 | Sweet |
| 2004/0267408 | A1 | 12/2004 | Kramer |
| 2005/0098643 | A1 | 5/2005 | Guyer |
| 2005/0156049 | A1 | 7/2005 | Van Ostrand et al. |
| 2005/0161520 | A1 | 7/2005 | Gast |
| 2005/0161521 | A1 | 7/2005 | Guyer |
| 2005/0230490 | A1 | 10/2005 | Pouchak et al. |
| 2005/0230491 | A1 | 10/2005 | Pouchak et al. |

* cited by examiner

AUTOMATIC SWITCHING TWO PIPE HYDRONIC SYSTEM

FIELD OF THE INVENTION

The present invention relates to air-conditioning systems and more particularly relates to an automatic switching two pipe hydronic system for conditioning a space.

BACKGROUND OF INVENTION

Space heating is a component of heating, ventilation, and air conditioning (HVAC) and is a predominant mode of conditioning space. Depending on the local climate, space heating is in operation up to and beyond seven months out of the year. During the time of such operation, there will be numerous occasions when cooling of the space will be needed to prevent discomfort and lost productivity of inhabitants of such space. Thus, the adjustability of HVAC systems is desirable. Space heating has traditionally been accomplished by two-pipe systems that incorporate a hot water boiler.

One approach to improve the adjustability of HVAC systems is shown by U.S. Pat. No. 4,360,152, which discloses an auxiliary heating system for reducing fuel consumption of a conventional forced-air heating system. A boiler tank substantially filled with water is connected by hot and cold water lines to a heat exchanger disposed within the cold air duct of the forced-air heating system. A firebox which extends into the boiler tank is adapted to receive combustible material such as wood for heating the water in the tank. A pump directs hot water from the tank through the hot water line to the heat exchanger whereby cool air moving through the cold air duct is preheated as it passes through the heat exchanger. Heating tubes in communication with water in the boiler tank may extend through the firebox for supporting logs therein. Additional heating tubes may extend through a flue directed upwardly from the firebox through the boiler tank. A disadvantage to the '152 disclosure is that requires the installation of an additional component to the existing HVAC system.

Another approach directed at the adjustability of HVAC systems is shown in U.S. Pat. No. 6,769,482, which discloses a HVAC device that includes both heating and cooling operating modes. The '482 disclosure provides an interface for selecting the operating parameters of the device. The interface allows the input of a set point temperature at which the HVAC device conditions the ambient temperature of a space. A mode switch-over algorithm uses the set point temperature, the sensed temperature from the conditioned space, and prestored threshold values that depend on the device's operating capacities, to determine when to change the device between heating and cooling modes. Within each of the respective modes, a heating or cooling algorithm controls the engaging and disengaging of the heating and cooling elements of the device to maintain the temperature of the conditioned space within a desired comfort zone. The '482 patent does not address the diverse and localized needs within large spaces, such as where a large space will require cooling in one area and heating in another area.

The use of variable speed pumps for control of HVAC systems has been adopted in U.S. Pat. No. 5,095,715, wherein an integrated heat pump and hot water system provides heating or cooling of a comfort zone, as required, and also provides water heating. As a power management feature, the speed of a variable speed compressor is reduced to a predetermined fraction of its normal operating speed, in response to a demand limit signal provided from the electric power utility during times of peak electrical load. A reference compressor speed is computed based on the current compressor speed, indoor temperature, outdoor temperature, and zero-load temperature difference. If the system is between operating cycles when the demand limit signal is received, a stored speed is used which corresponds to the compressor speed at a predetermined outdoor-indoor temperature difference. The '715 disclosure fails to address the diverse and localized needs within large spaces, such as where a large space will require cooling in one area and heating in another area.

Notwithstanding these efforts, the prior art fails to improve the functionality and adjustability of HVAC systems to meet today's needs of energy conservation and quick changeover from heating to cooling in a space and of being able to provide heating and cooling at the same by the same system.

Accordingly, there is a need in the art for an improved HVAC system that can use water in an efficient manner, for instance from both the cooling side and boiler side of a space heating configuration. Because of the higher costs of the construction of new buildings, there is also a need for an improved HVAC system that will be able to be retrofitted to existing spaces at a cost that is less than the installation of an entirely new HVAC system. There is also a need for an adjustable system that offers simultaneous cooling and heating, depending on the need of the particular subunit of the space in which the HVAC operates.

SUMMARY OF THE INVENTION

In view of the foregoing disadvantages inherent in the prior art, the general purpose of the present invention is to provide a system for conditioning a space and to include all the advantages of the prior art, and to overcome the drawbacks of the prior art.

In one aspect, the present invention provides an automatic switching two pipe hydronic system. The system comprises: a supply line; a return line; a primary boiler; a secondary boiler; a heat exchanger; a primary chiller; a secondary chiller; a cooling tower; at least one closed loop pump; a plurality of flow control valves; a plurality of sensors; and a controlling module. The supply line is configured to supply a conditioned fluid to a space. The return line is configured to return utilized conditioned fluid from the space. The primary boiler is in fluid communication with the supply line and the return line and capable of operating in a first full load condition. The secondary boiler is in fluid communication with the supply line and the return line and the secondary boiler is capable of operating in a first part load condition. The heat exchanger is in fluid communication with the supply line and the return line and the heat exchanger is configured to transfer heat between the return line and the supply line. The primary chiller is in fluid communication with the supply line and the return line, capable of operating in a second full load condition. The secondary chiller is in fluid communication with the supply line, and the return line and the secondary chiller is capable of operating in a second part load condition. The cooling tower is in fluid communication with the heat exchanger; the primary chiller; and, the secondary chiller. The cooling tower is configured to take away heat from the heat exchanger, the primary chiller and the secondary chiller. The closed loop pump has a variable speed drive and the closed loop pump is capable of regulating the flow between the return line and the supply line. The flow control valves are disposed in the supply line and the return line. The flow control valves are capable of controlling the flow of fluid through the supply and return line and the primary boiler, the secondary boiler, the heat exchanger, the primary chiller, the secondary chiller, and the cooling tower. The sensors are configured for sensing an outside space temperature, an inside space temperature, and temperature of the fluid in the supply line and the return line. The controlling module is configured to acquire temperatures from the plurality of sensors and is capable of controlling the flow of fluid through the flow control valves.

In another aspect, the present invention provides a method for automatically switching a first mode of operation to a second mode of operation during conditioning a space by conditioning a return fluid in a return line to be supplied as a supply fluid in a supply line of a system having a primary boiler, a secondary boiler, a heat exchanger, a primary chiller, a secondary chiller, a cooling tower and a closed loop pump. The method comprises: switching the primary boiler providing heated supply fluid in the first mode of operation to a standby mode upon determining an increase in an outside space temperature; switching the secondary boiler to an operational mode for reducing the temperature of the supply fluid in the supply line by heating the return fluid from the return line in the secondary boiler to a temperature less than the temperature of the heated supply fluid; disabling the secondary boiler and enabling a variable speed drive of the closed loop pump for regulating the flow of supply fluid to the supply line; enabling the heat exchanger for reducing the temperature of the return fluid in the return line to be supplied as the supply fluid in the supply line by transferring heat of the return fluid to the cooling tower; disabling the heat exchanger and enabling the secondary chiller for reducing the temperature of the return fluid in the return line to be supplied as the supply fluid in the supply line by transferring heat of the return fluid to the cooling tower; enabling the primary chiller and receiving the fluid from the secondary chiller into the primary chiller for reducing the temperature of the fluid from the secondary chiller to be supplied as the supply fluid in the supply line by transferring heat of the fluid from the primary chiller to the cooling tower; and disabling the secondary chiller for switching the system to the second mode of operation.

In another aspect, the present invention provides a system for simultaneously heating and cooling a first portion and a second portion of a space. The system comprises: a first flow path; a second flow path; a plurality of closed loop pumps; a plurality of boilers; a plurality of heat exchangers; a plurality of chillers; a plurality of condenser pumps; a plurality of boiler flow control valves; a plurality of chiller flow control valves; a plurality of heat exchanger flow control valves; a plurality of sensors; and a controlling module. The first flow path is disposed towards the first portion and the first flow path is having a first supply line and a first return line. The second flow path is disposed towards the second portion and the second flow path is having a second supply line and a second return line. The supply line is configured to supply a conditioned fluid to the space and the return line is configured to return utilized conditioned fluid from the space. The closed loop pump is capable of circulating the conditioned fluid and the utilized conditioned fluid between the supply and return lines of the first flow path and the second flow path. The boilers are disposed between the first portion and the second portion and the boilers are capable of providing conditioned fluid to the first supply line and the second supply line. The heat exchangers are disposed between the first portion and the second portion and the heat exchangers are capable of receiving utilized conditioned fluid from the first and the second return line, for reducing the temperature of the utilized conditioned fluid in the first return line and the second return line to be supplied as the conditioned fluid to the first supply line and the second supply line by transferring heat of the utilized conditioned fluid to a cooling tower fluid. The chillers are disposed between the first portion and the second portion. The chillers are capable of receiving utilized conditioned fluid from the first return line and the second return line, for reducing the temperature of the utilized conditioned fluid in the first return line and the second return line to be supplied as the conditioned fluid to the first supply line and the second supply line by transferring heat of the utilized conditioned fluid to the cooling tower fluid. The condenser pumps are disposed between the first flow path and the second flow path. The condenser pumps are capable of circulating a cooling tower fluid between the cooling tower and the plurality of heat exchangers and the plurality of chillers. The boiler flow control valves are coupled to the plurality of boilers. The boiler flow control valves are capable of controlling the flow of utilized conditioned fluid to the boilers from the first and second return lines and conditioned fluid from the boiler to the first and second supply lines. The chiller flow control valves are coupled to the plurality of chillers and are capable of controlling the flow of utilized conditioned fluid to the chillers from the first and second return lines and conditioned fluid from the chillers to the first and second supply lines. The heat exchanger flow control valves are coupled to the plurality of heat exchangers and are capable of controlling the flow of utilized conditioned fluid to the heat exchangers from the first and second return lines and conditioned fluid from the heat exchangers to the first and second supply lines. The sensors are configured for sensing an outside space temperature, a temperature of the first portion and the second portion inside the space, and temperatures of the conditioned fluid and the utilized conditioned fluid in the first flow path and the second flow path. The controlling module is configured to acquire temperatures from the plurality of sensors and is capable of controlling the flow of conditioned fluid and utilized conditioned fluid through the boiler, chiller and heat exchanger flow control valves. The controlling module is configured to operate the boiler, the chiller and the heat exchanger flow control valves in a manner such that at least one boiler from the plurality of boilers and at least one chiller from the plurality of chillers or at least one heat exchanger from the plurality of heat exchangers are capable of heating or cooling the first portion and the second portion simultaneously.

These together with other aspects of the present invention, along with the various features of novelty that characterize the invention, are pointed out with particularity in the claims annexed hereto and form a part of this disclosure. For a better understanding of the invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

Figure 1:
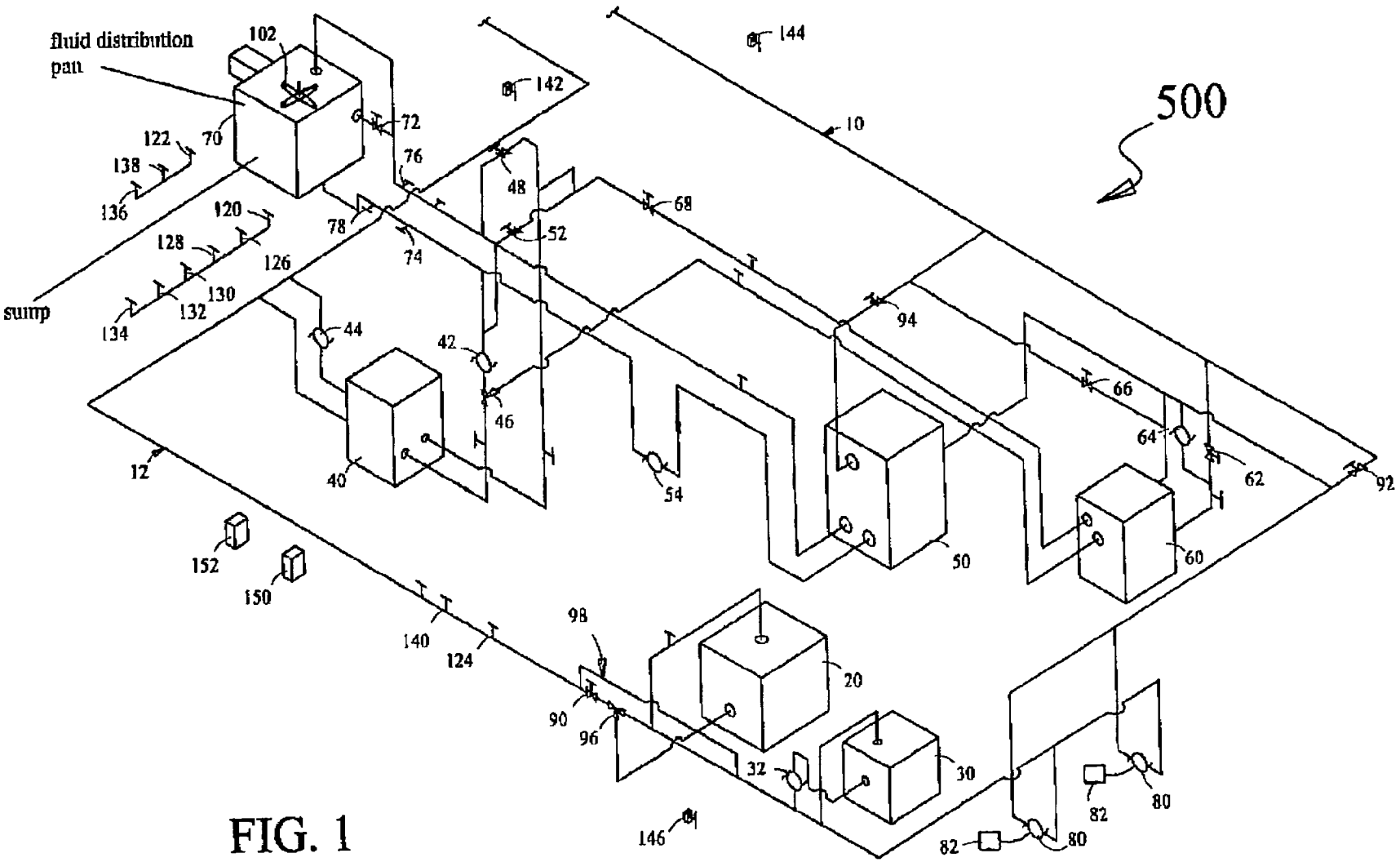
FIG. 1 is a schematic line diagram of an automatic switching two pipe hydronic system 500; according to an exemplary embodiment of the present invention.

The exemplary embodiments described herein detail for illustrative purposes are subject to many variations in structure and design. It should be emphasized, however, that the present invention is not limited to an automatic switching two pipe hydronic system as shown and described. It is understood that various omissions, substitutions, and equivalents are contemplated as circumstances may suggest or render expedient, but it is intended to cover the application or implementation without departing from the spirit or scope of the claims of the present invention. The terms "a", an "first", and "second", herein do not denote a limitation of quantity, but rather denote the presence of at least one of the referenced item.

It should be noted that the various temperature ranges and corresponding operational set points discussed herein are for illustrative purposes only and that the particular set points and temperature ranges will depend on the particular geographic location and climate conditions of the space in which the present invention is put into use and on the settings chosen by the particular user.

The present invention provides an automatic switching two pipe hydronic system for conditioning a space. The automatic switching two pipe hydronic system of the present is applicable to commercial and residential complexes. The automatic switching two pipe hydronic system capable of switching from first mode of operation (heating) to second mode of operation (cooling) or vice versa in a reduced span of time of approximately four hours or less, for each mode. The present invention improves the existing two pipe hydronic system with a lower cost solution. The present invention aims at saving fuel, energy and water, when there are lower load conditions that affect boilers, chillers, and cooling towers. The configurational modifications proposed by the present invention aim at increasing: occupant productivity and comfort, reduction in maintenance, future capital expense, prolonged major equipment life span, and improvement of the environment. Further, the present invention is capable of simultaneously heating and cooling different portions of a building in an efficient manner. The present invention can be easily configured by making minor configurational amendments in existing system thereby aiding the versatility of the present invention.

Referring to FIG. 1-6, an automatic switching two pipe hydronic system 500 for conditioning a space is shown. As used herein, a 'space' refers to an enclosed portion of a building that needs to be conditioned. The automatic switching two pipe hydronic system 500 comprises a supply line 10, a return line 12, a primary boiler 20, a secondary boiler 30, a heat exchanger 40, a primary chiller 50, a secondary chiller 60, a cooling tower 70, closed loop pumps 80, a plurality of flow control valves, a plurality of sensors, and a controlling module. As used herein, a 'supply line' refers to a flow path that carries conditioned fluid to the space and a 'return line' refers to a flow path that carries utilized fluid back from the space. The supply line 10 and the return line 12 are configured to carry conditioned fluid and utilized condition fluid respectively. The primary boiler 20 and secondary boiler 30 are in fluid communication with the supply line 10 and the return line 12 and are configured to provide heating to the space in a first full load condition and a first part load condition respectively. The heat exchanger 40 is in fluid communication with the supply line 10 and the return line 12 and configured to transfer heat between the supply line 10 and the return line 12. The primary chiller 50 and secondary chiller 60 are in fluid communication with the supply line 10 and the return line 12 and configured to provide cooling to the space in a second full load condition and a second part load condition respectively. The cooling tower 70 is in fluid communication with the heat exchanger 40 such that the cooling tower 70 is configured to take away the heat from the primary chiller 50 and secondary chiller 60. The closed loop pumps 80 are in fluid communication with the supply line 10 and the return line 12 and are configured to regulate the flow of fluid between the supply line 10 and the return line 12. The flow control valves are disposed in the supply line 10 and the return line 12 and capable of controlling the flow of fluid in the supply line 10 and the return line 12 of the primary boiler 20, the secondary boiler 30, the heat exchanger 40, the primary chiller 50, the secondary chiller 60 and the cooling tower 70. The sensors sense the outside space temperatures, inside space temperatures, and temperature of the fluid in the supply line 10 and return line 12. The controlling module is configured to acquire temperature from the sensors and accordingly control the flow of the fluid through the flow control valves.

The automatic switching two pipe hydronic system 500 operates upon direction of the controlling module (building automation system) in a manner such that the temperature sensors associated with the controlling module sense the temperature of the space and communicate with the controlling module. The controlling module may include a wireless control module, a digital control module, a normal sensor network, and the like.

Figure 2:
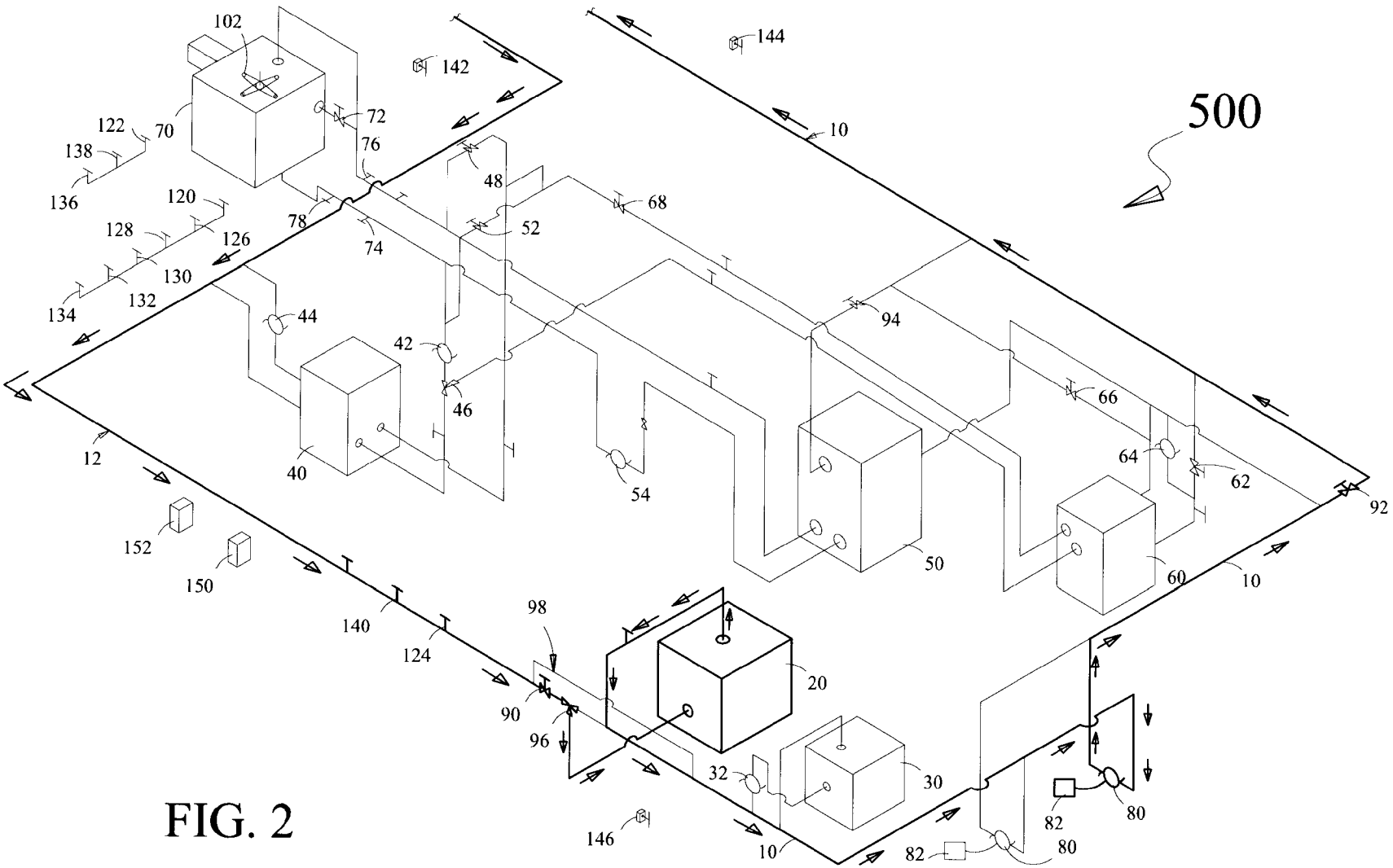
FIG. 2 is a schematic line diagram of the automatic switching two pipe hydronic system 500 illustrating a primary boiler 20 in an operational mode, according to an exemplary embodiment of the present invention.

Referring to FIG. 2, the primary boiler 20 is shown in an operational mode in a first full load condition. The primary boiler 20 operates in the first full load condition once a main heating sensor 120 senses a temperature of 40° F. and below. The first full load condition is an operational stage/phase of the automatic switching two pipe hydronic system 500 when the primary boiler 20 switches from a standby mode to the operational mode such that the main heating sensor 120 senses a temperature of 40° F. or less and the primary boiler 20 is in operational mode. The main heating sensor 120 further communicates with an outside space sensor 122 disposed outside of the space and a space heat return sensor 124 disposed in the return line 12. The main heating sensor 120 communicates with the outside space sensor 122 and the space heat return sensor 124 once the primary boiler 20 is operating in first full load condition. The main heating sensor 120 further associates and communicates with a heat sensor 126, a heat sensor 128, a heat sensor 130, a heat sensor 132 and a heat sensor 134.

The primary boiler 20 operates as primary source of heating for the automatic switching two pipe hydronic system 500 when the main heating sensor 120 senses a temperature of 40° F. and less. Once the temperature of the main heating sensor 120 reaches below 40° F. a summer winter valve 90 and a heat return 3-way valve 96 open. The heat return 3-way valve 96 has its own temperature reset control 150, coupled to the controlling module, which is enabled by the main heating sensor 120. In the above mentioned condition, the return line 12 carries utilized conditioned fluid of 120° F., as sensed by the space heat return sensor 124, once the primary boiler 20 is switched from the standby mode to the operational mode. The utilized conditioned fluid flows through the return line 12 after being utilized in the space that needs conditioning. Now, the utilized conditioned fluid in the return line 12 passes through the summer winter valve 90 which direct the flow of the utilized conditioned fluid towards the heat return 3-way valve 96. The heat return 3-way valve 96 sends the utilized conditioned fluid to the primary boiler 20 which has been switched from the standby mode to the operational mode. The primary boiler 20 increases the temperature of the utilized conditioned fluid from 120° F. to 140° F. The primary boiler 20 now delivers a conditioned fluid to the supply line 10 for conditioning the space having a temperature of 140° F. The supply line 10 now delivers the conditioned fluid to the either of the closed loop pumps 80, associated with a variable speed drive 82, for regulating the flow through supply line 10. The variable speed drive 82 has a schedule to operate the velocity of either close loop pumps 80 in relation to an outside space sensor 136. From the closed loop pump 80 the supply line 10 delivers the conditioned fluid to a summer winter valve 92. The summer winter valve 92 has its own temperature reset control, coupled to the controlling module, which is enabled by the main heating sensor 120. The summer winter valve 92 now delivers the conditioned fluid to the space through the supply line 10. The conditioned fluid is utilized for conditioning the space and hereinafter the conditioned fluid becomes utilized conditioned fluid. After conditioning the space, the utilized conditioned fluid is delivered to the return line 12, wherein the temperature of the utilized conditioned fluid is less then the temperature of the conditioned fluid in the supply line 10. The primary boiler 20 continue to operates until the temperature of the main heating sensor 120 senses a temperature of 40° F. and less.

Figure 3:
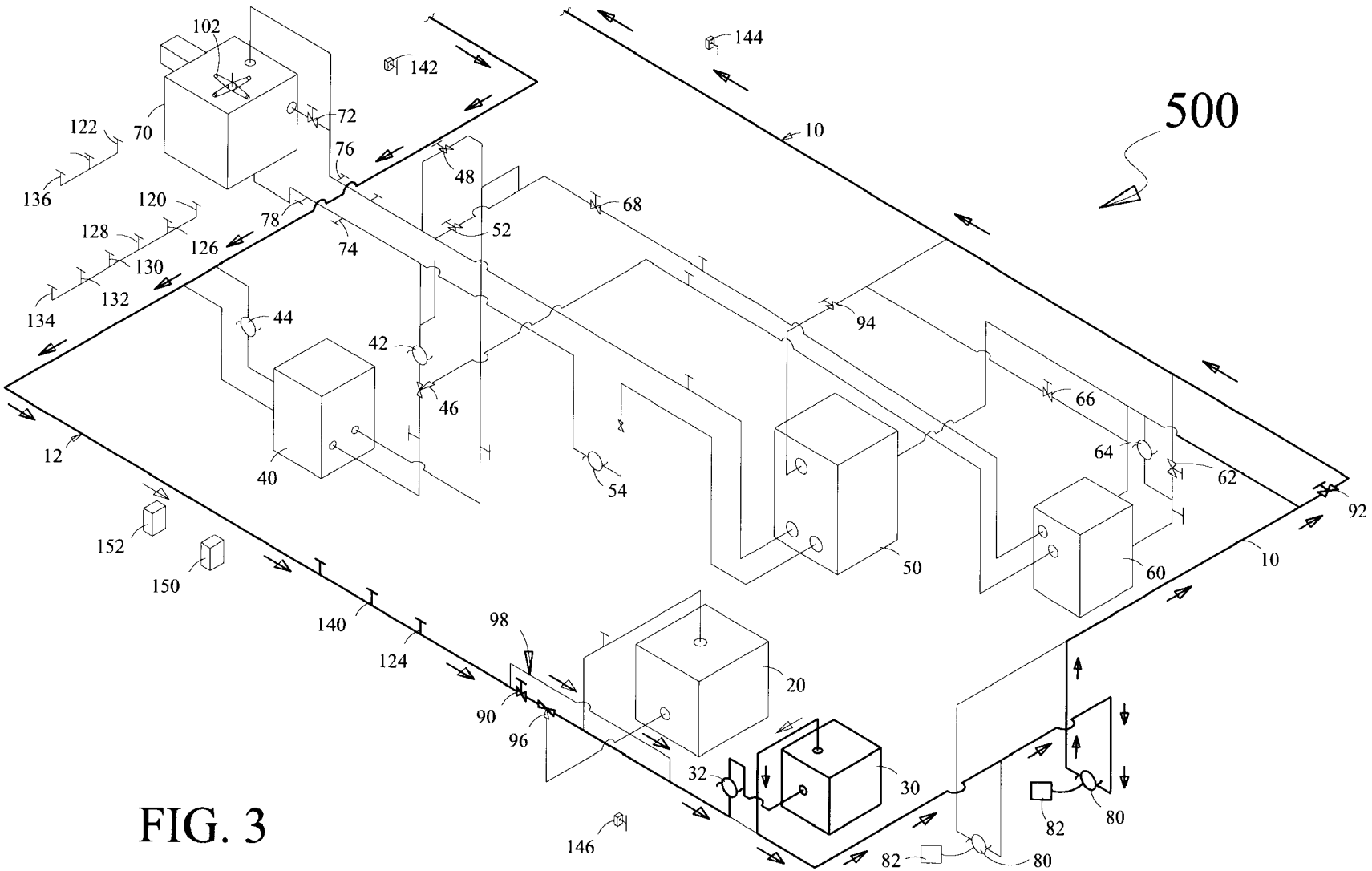
FIG. 3 is a schematic line diagram of the automatic switching two pipe hydronic system 500 illustrating a secondary boiler 30 in an operational mode, according to an exemplary embodiment of the present invention.

With an increase in an outside space temperature, the temperature of the main heating sensor 120 reaches 41° F. and more, switches the secondary boiler 30 to an operational mode for reducing the temperature of the conditioned fluid in the supply line 10 by heating the utilized conditioned fluid of the return line 12 in the secondary boiler to a temperature less than the temperature of the heated primary boiler 20, refer to FIG. 3. The primary boiler 20 switches from operational mode to standby mode and secondary boiler 30 starts operating in a first part load condition. The first part load condition is an operational stage/phase of the automatic switching two pipe hydronic system 500 when the primary boiler 20 switches to the standby mode, such that the main heating sensor 120 senses a temperature of 41° F. or more and the secondary boiler 30 is in operational mode. The main heating sensor 120 further communicates with an outside space sensor 138 disposed in the outside space and a space heat return sensor 140 disposed in the return line 12.

The secondary boiler 30 operates as primary source of heating for the automatic switching two pipe hydronic system 500 when the main heating sensor 120 senses a temperature of 41° F. and more. On sensing the temperature of 41° F. and more, the summer winter valve 92 remains open and the heat return 3-way valve 96 closes for the primary boiler 20. The main heating sensor 120 enables a temperature reset control 152 coupled to the controlling module. The temperature reset control 152 enables a secondary boiler pump 32, associated with the secondary boiler 30, to provide required flow according to the temperature reset control 152. In the above mentioned condition, the temperature of the conditioned fluid is brought down because of the increase in the outside space temperature. The temperature of the conditioned fluid is brought down by operating the secondary boiler 30 and switching the primary boiler 20 to the standby mode, as the secondary boiler 30 is smaller in size and capacity compared to the primary boiler 20. Here, the utilized conditioned fluid in the return line 12 passes through the secondary boiler pump 32 to the secondary boiler 30. The secondary boiler 30 now delivers a conditioned fluid that has been conditioned for conditioning the space to the supply line 10; herein the temperature of the conditioned fluid is 120° F. The conditioned fluid from the supply line 10 is delivered to either of the closed loop pumps 80 that is associated with a variable speed drive 82 for regulating the flow in the supply line 10. The variable speed drive 82 has a schedule to operate the velocity of either closed loop pumps 80 in relation to the outside space sensor 136. From the closed loop pump 80 the supply line 10 delivers the conditioned fluid to the summer winter valve 92. The summer winter valve 92 now delivers the conditioned fluid to the space through the supply line 10. The conditioned fluid is utilized for conditioning the space and hereinafter the conditioned fluid becomes utilized conditioned fluid. After conditioning the space the utilized conditioned fluid is delivered to the return line 12, wherein the temperature of the utilized conditioned fluid is less then the temperature of conditioned fluid. The secondary boiler 20 continues to operate till the temperature of the main heating sensor 120 senses temperature of 40° F. to 50° F. The secondary boiler 30 should provide a conditioned fluid of 90° F. when the main heating sensor senses the temperature of 40° F. to 50° F.

With an increase in outside temperature, the temperature of the main heating sensor 120 reaches 51° F. and more, as sensed by the outside space sensor 126. The outside space sensor 126 provides a contact closure which closes the summer winter valve 90 and switches off the primary boiler 20. The switching off of the primary boiler 20 brings down the temperature of the conditioned fluid in the supply line 10. Once the main heating sensor 120 senses a decrease in temperature to 50° F. and less, the outside space sensor 126 reverses the operation. In this case secondary boiler 30 is switched on and further decrease in the temperature of main heating sensor 120 switches the primary boiler 20 to operational mode from standby mode for delivering a conditioned fluid according to controlling module.

Figure 4:
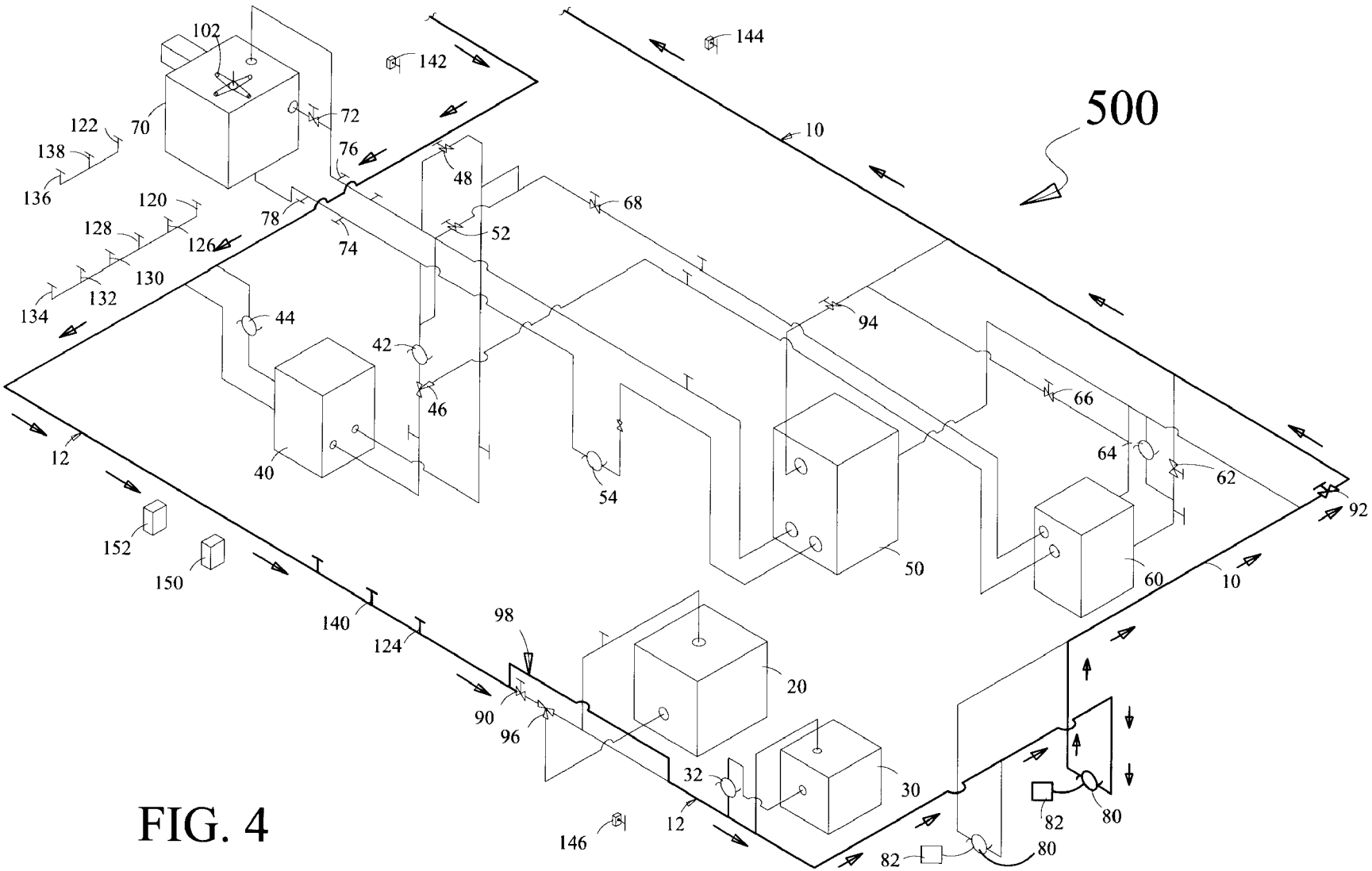
FIG. 4 is a schematic line diagram of the automatic switching two pipe hydronic system 500 illustrating a closed loop pump 80 in an operational mode, according to an exemplary embodiment of the present invention.

Another increase in main heating sensor 120, the temperature of 50° F. to 56° F., as sensed by the outside space sensor 128, disables the secondary boiler 30 and enables the variable speed drive 82 of the closed loop pump 80 for regulating the flow of conditioned fluid of the supply line 10, refer to FIG. 4. More particularly, the outside space sensor 128 disables the secondary boiler pump 32 to stop the flow of conditioned fluid in the supply line 10. The increase in the temperature of the main heating sensor 120 should result in decreasing the temperature of the conditioned fluid in the supply line 10. In the above mentioned condition the utilized conditioned fluid in the return line 12 is allowed to pass through a loop 98 bypassing the summer winter valve 92 and the heat return 3-way valve 96 to either of the close loop pumps 80. Here, the flow of utilized conditioned fluid flowing through the close loop pump 80 is regulated such that the outside space sensor 136 enables the variable speed drive 82 of the close loop pump 80 for regulating the flow of the fluid in the supply line 10. The variable speed drive 82 continue to operate at 80% of rated capacity, such that the amount of the conditioned fluid in the supply line 10 decreases due to less heat required for the space to be conditioned. The closed loop pump 80 continues to operate till the temperature of the main heating sensor 120 senses temperature of 50° F. to 56° F. The closed loop pump 80 should provide a conditioned fluid of 80° F. once the main heating sensor senses a temperature of 50° F. to 56° F.

Figure 5:
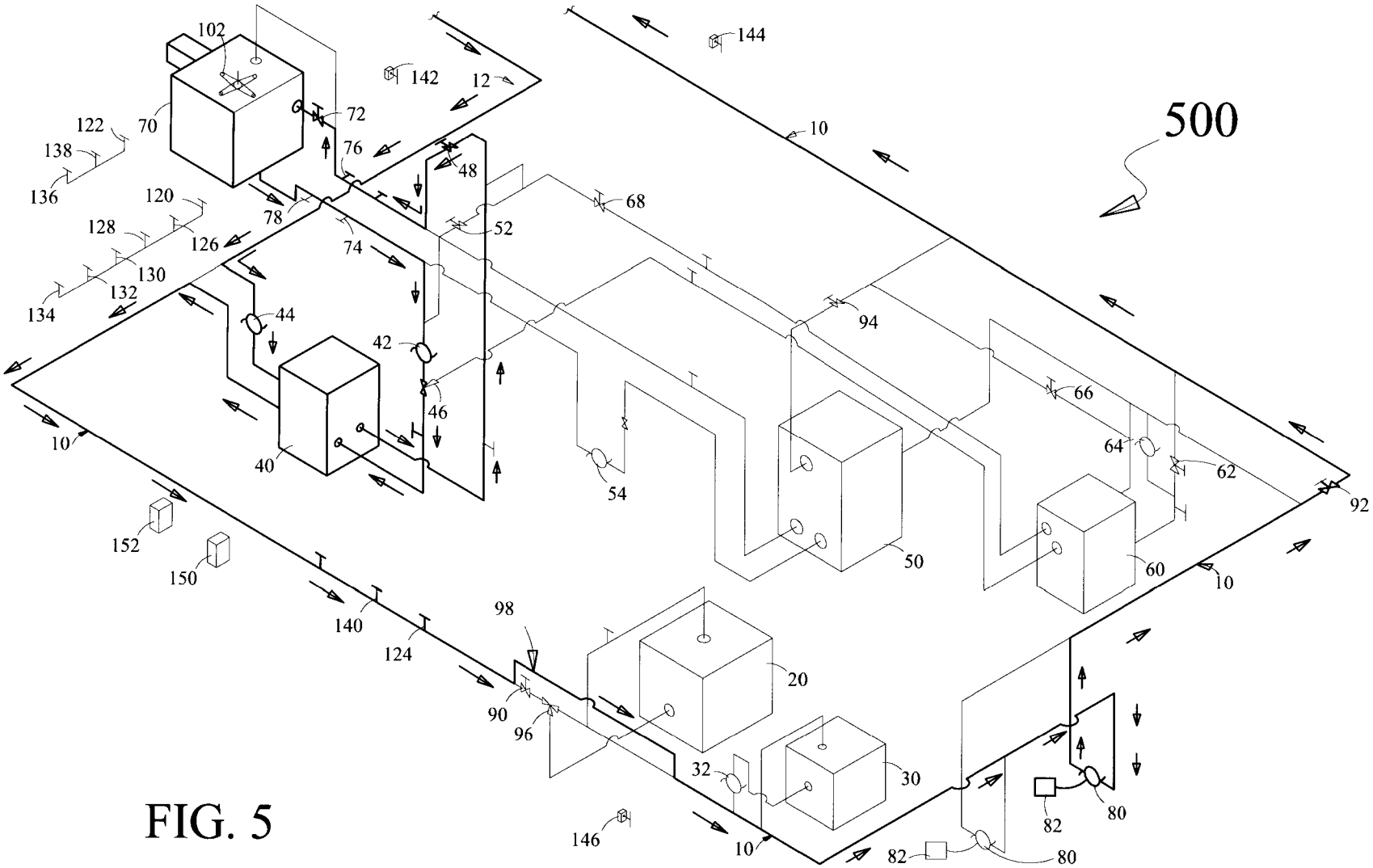
FIG. 5 is a schematic line diagram of the automatic switching two pipe hydronic system 500 illustrating a heat exchanger 40 and a cooling tower 70 in an operational mode, according to an exemplary embodiment of the present invention.

A further increase in the temperature of the main heating sensor 120 to a temperature of 58° F. and more, as sensed by the outside space sensor 130, enables the heat exchanger 40 for reducing the temperature of the utilized conditioned fluid in the return line 12 to be supplied as the conditioned fluid in the supply line 10 by transferring heat of the water to the cooling tower 70 (See FIG. 5). More particularly, the outside space sensor 130 will provide a contact closure that will enable the following processes: a cooling tower bypass valve 72 opens, a small condenser 3-way valve 46 opens to the heat exchanger 40, a heat exchanger pump 42 starts the flow of water from the cooling tower 70 through the condenser side of heat exchanger 40. The increase in the temperature of the main heating sensor 120 should result in decreasing the temperature of the conditioned fluid in the supply line 10. In the above mentioned condition, a heat exchanger pump 44 pumps the utilized conditioned fluid of the return line 12 through the closed loop side of the heat exchanger 40 for cooling the utilized conditioned fluid in the return line 12. The utilized conditioned fluid in the return line 12 enters the heat exchanger 40 and dissipates the heat to the heat exchanger 40, and the supply line 10 carries a conditioned fluid from the heat exchanger 40. Here, the heat exchanger pump 42 starts the flow of water in the condenser side of the heat exchanger 40 such that the heat exchanger pump 42 pumps the water through a small condenser cooling tower check valve 48 to the cooling tower 70 through the opened cooling tower bypass valve 72. The water from the cooling tower bypass valve 72 is directed to the sump of the cooling tower 70 for cooling. The cold water from the cooling tower 70 is delivered to the heat exchanger pump 42, which directs the cold water through the small condenser 3-way valve 46 to the heat exchanger 40. Meanwhile, a contact closure from the outside sensor 130 disables a burner (not shown) of the secondary chiller 60 and the temperature reset control 152. The supply line 10 from the heat exchanger 40 carries conditioned fluid passes through the loop 98 bypassing the summer winter valve 90 and the heat return 3-way valve 96 to either of the closed loop pumps 80. The flow of conditioned fluid flowing through the close loop pump 80 is regulated such that the outside space sensor 136 enables the variable speed drive 82 of the closed loop pump 80 for regulating the flow of the conditioned fluid in the supply line 10. From the closed loop pump 80 the supply line 10 delivers the conditioned fluid to the summer winter valve 92, which delivers the conditioned fluid to the space that needs to be conditioned through the supply line 10. The conditioned fluid is utilized for conditioning the space and thereafter the conditioned fluid becomes a utilized conditioned fluid. After conditioning the space, the utilized conditioned fluid is delivered to the return line 12, wherein the temperature of the utilized conditioned fluid is more than the temperature of the conditioned fluid. The heat exchanger 40 continue to operates till the temperature of the main heating sensor 120 senses temperature of 58° F. to 68° F. The heat exchanger 40 should provide a conditioned fluid at 75° F. once the main heating sensor 120 senses a temperature of 58° F. to 68° F.

The outside space sensor 130 enables an interior space heating sensor network comprising an interior space heating sensor 142, 144 and 146, the interior space heating sensor network has a set point of 75° F. Once the set point of the interior space heating sensor network reaches 75° F. and the temperatures of the conditioned fluid of the supply line 10 reaches 65° F. or less, the cooling tower water entering the heat exchanger 40 reaches 60° F. and higher. The cooling tower water entering the heat exchanger 40 is sensed by a cooling tower sensor 74. The set point of the interior space heating sensor network may be adjusted depending upon the space to be conditioned. When the set point of the interior space heating sensor network and the temperatures of the conditioned fluid of the supply line 10 reaches the above mention set point, a contact closure is made, but not completed until an outside space sensor 132 reaches a set point, between 69° F. and 74° F.

Figure 6:
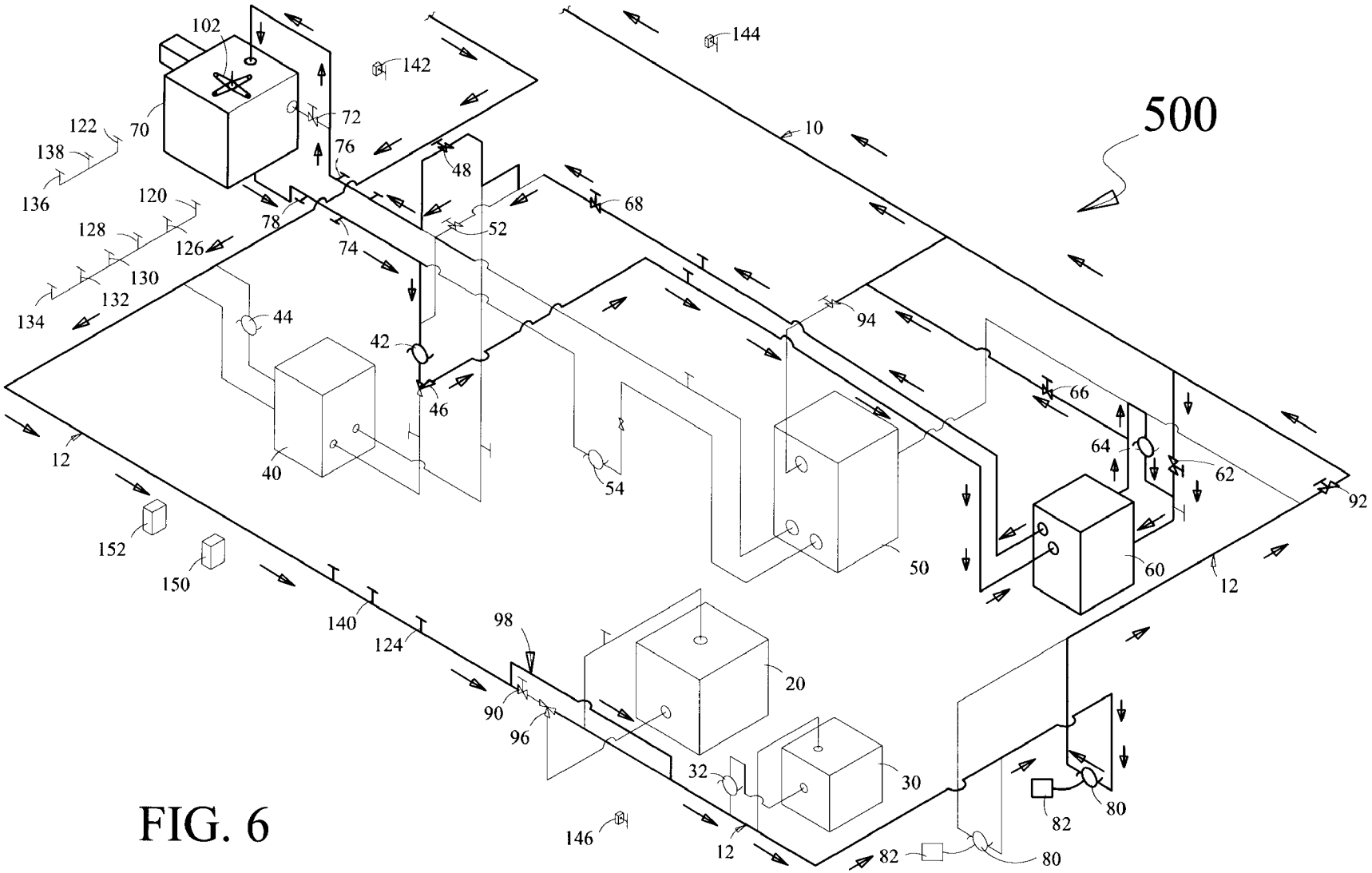
FIG. 6 is a schematic line diagram of the automatic switching two pipe hydronic system 500 illustrating a secondary chiller 60 and the cooling tower 70 in an operational mode, according to an exemplary embodiment of the present invention.

A further increase in the temperature of the main heating sensor 120, the temperature of 69° F., as sensed by the outside space sensor 132, causes the heat exchanger 40 to disable and the secondary chiller 60 becomes enabled for reducing the temperature of the utilized condition fluid in the return line 12 to be supplied as the conditioned fluid in the supply line 10 by transferring heat of the utilized conditioned fluid to the cooling tower 70 (See FIG. 6). The secondary chiller 60 now operates in a second part load condition; the second part load condition is an operational stage/phase of the automatic switching two pipe hydronic system 500 when the secondary chiller 60 switches to the operational mode, when the main heating sensor 120 senses a temperature of 69° F. The secondary chiller 60 starts once the outside space sensor 132 reaches a set point of 68° F. to 74° F. The outside space sensor 132 provides a contact closure for a small condenser bypass valve 52 to open; a small chiller control valve 62 to open halfway; and a secondary chiller bypass valve 66 to open halfway and verify the operations of the heat exchanger pump 42 and a secondary chiller pump 64. The secondary chiller 60 has its own sensor network to regulate its operation. The secondary chiller 60 and sensor network of the secondary chiller are capable of operating each of the small condenser 3-way valve 46, the secondary chiller bypass valve 66 and the small chiller control valve 62, to include: open, closed, open half, and closed half position of the valves, during the secondary chiller 60 operation.

In the above mentioned condition a heat exchanger pump 44 is switched off and the utilized conditioned fluid is directed through the loop 98 bypassing the summer winter valve 90 and the heat return 3-way valve 96 to either of the closed loop pumps 80. The flow of utilized conditioned fluid flowing through the close loop pump 80 is regulated such that the outside space sensor 136 enables the variable speed drive 82 of the closed loop pump 80 for regulating the flow of the utilized conditioned fluid in the return line 12. From the closed loop pump 80, the return line 12 delivers the conditioned fluid to the summer winter valve 92. The summer winter valve 92 now delivers the utilized conditioned fluid to the secondary chiller valve 62 which directs the utilized conditioned fluid to enter into the secondary chiller 60. The utilized conditioned fluid is conditioned in the small chiller 60 by dissipating the heat to the secondary chiller 60. Here, the heat exchanger pump 42 stops flow of water from the cooling tower towards the heat exchanger 40 and the secondary chiller 60 enables the small condenser 3-way valve 46 to direct the flow of water from the cooling tower 70 to the secondary chiller 60. The heat of the utilized conditioned fluid is carried away by the water moving from the secondary chiller 60 to the cooling tower 70. The water, carrying the heat of the utilized conditioned fluid, is directed to a secondary chiller condenser check valve 68 and then to the small condenser cooling tower check valve 48, which directs the flow of water to the cooling tower 70 through the cooling tower bypass valve 72. The water from the cooling tower bypass valve 72 is directed to the sump of the cooling tower 70 for cooling. The cold water from the cooling tower 70 is delivered to the heat exchanger pump 42, which directs the cold water through the small condenser 3-way valve 46 to the secondary chiller 60. If the water delivered from the cooling tower 70 is too cold, a small condenser bypass valve 52 reduces the flow of the cooling tower and diverts condenser water back to secondary chiller 60. The utilized conditioned fluid is now conditioned in the secondary chiller 60 and the secondary chiller 60 sends the conditioned fluid towards the supply line 10. The supply line for the secondary chiller 60 is disposed with a secondary chiller bypass valve 66 which starts at half-opened position for directing the conditioned fluid of the secondary chiller 60 to the space needs to be conditioned. If the conditioned fluid of the secondary chiller 60 is too cold, the secondary chiller pump 64 returns the conditioned fluid to the secondary chiller pump 60 for reducing the temperatures of the conditioned fluid, to be sent in the supply line 10. The conditioned fluid is now sent to the space for conditioning the space which needs conditioning. After conditioning the space, the utilized conditioned fluid is delivered to the return line 12. The secondary chiller 60 continues to operate till the temperature of the main heating sensor 120 senses temperature of 69° F. to 74° F. The secondary chiller 60 should provide a conditioned fluid at 65° F. once the main heating sensor 120 senses a temperature of 69° F. to 74° F.

While the secondary chiller 60 is operating in the second part load condition, the temperature of the water flowing from the cooling tower 70 increases. The restricted flows will be opened and the small condenser 3-way valve 46 directs the cooling tower water by closing 52. A sensor 76 will provide a contact closure to close the cooling tower bypass valve 72 and the cooling tower bypass valve 72 increases the cooling when the secondary chiller's 60 condenser inlet water reaches 80° F. and more.

The variable speed drives 82 of the closed loop pumps 80 are programmed to receive a contact closure from an outside sensor temperature 132 to operate at 90% of capacity for conditioned fluid, in the beginning of secondary chiller 60. The flow through the secondary chiller 60 is achieved by the flow generated by either of the closed loop pumps 80, for the entering and leaving the utilized conditioned fluid and the conditioned fluid to and from the secondary chiller 60. The opening of the secondary chiller control valve 62 and secondary chiller bypass valve 66 permits the secondary chiller pump 62 to shut down when the secondary chiller control valve 62 and secondary chiller bypass valve 66 are open. The secondary chiller 60 may be sized to handle different loads ranging from 78° F. to 84° F.

Further, increase in the temperature of the water flowing from the cooling tower 70, to temperature of 80° F., the cooling tower supply water sensor 78 closes the cooling tower bypass valve 72 and directs the cooling tower water to the pass through a pan (not shown), disposed on the top of the cooling tower 70, that adds the cooling ability of the cooling tower system to the cooling tower 70. The cooling tower 70 is equipped with a fan 102 which couple to a variable speed drive for regulating the speed of the fan 102. The speed of the fan 102 is related to the temperature of the water leaving from the cooling tower 70 and entering the secondary chiller 60. The drive of the fan 102 is programmed to produce the maximum chiller efficiency on direction of the secondary chiller 60. In this case, when there is a further increase in the temperature of the water flowing from the cooling tower 70 and the automatic switching two pipe hydronic system 500 is operating in the second part load condition, the cooling tower bypass valve 72 is closed and the fan 102 is switched on, for increasing the efficiency of the secondary chiller 60.

Figure 7:
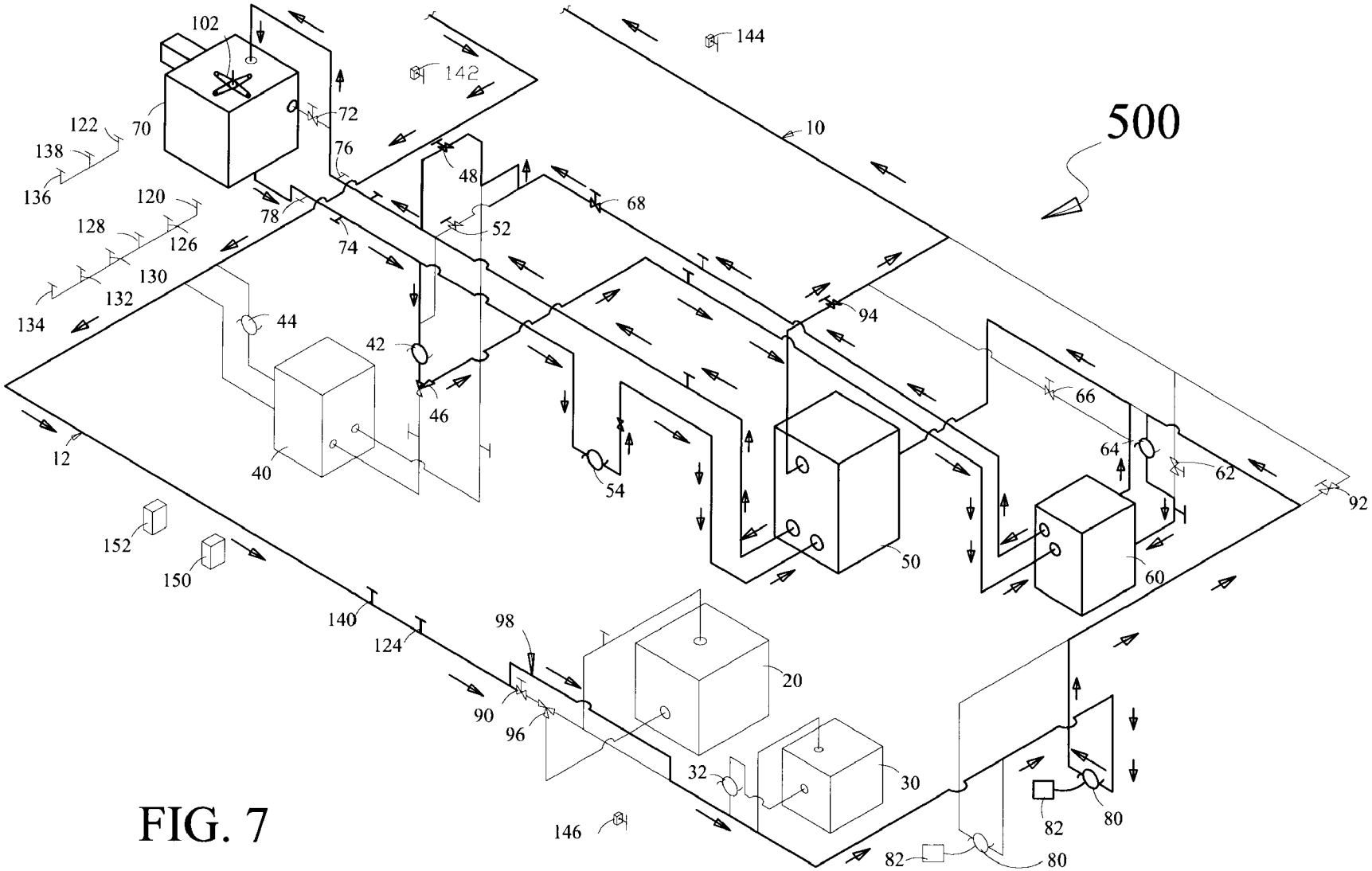
FIG. 7 is a schematic line diagram of the automatic switching two pipe hydronic system 500 illustrating a primary chiller 50, the secondary chiller 60 and the cooling tower 70 in an operational mode, according to an exemplary embodiment of the present invention.

Another increase in the temperature of the main heating sensor 120, the temperature of 78° F., as sensed by the outside space sensor 134, enables the primary chiller 50 for receiving the fluid from the secondary chiller 60 into the primary chiller 50 for reducing the temperature of the utilized conditioned fluid from the secondary chiller 60 to be supplied as the conditioned fluid in the supply line 10 by transferring heat of the utilized conditioned fluid from the primary chiller 50 to the cooling tower 70 (See FIG. 7). The primary chiller 50 now operates in a second full load condition, the second full load condition is an operational stage/phase of the automatic switching two pipe hydronic system 500 when the primary chiller 50 switches to the operational mode, such that, the main heating sensor 120 senses a temperature of 78° F. The primary chiller 60 starts once the outside space sensor 134 reaches a set point of 78° F. and more. More particularly, the outside space sensor 134 provides a contact closure which closes the summer winter valve 92, the secondary chiller valve 62 and opens the summer winter valve 94. Additionally, the secondary chiller bypass valve 66 closes and directs the secondary chiller 60 directing the conditioned fluid of the secondary chiller 60 to enter into the primary chiller 50.

Directing the conditioned fluid of the secondary chilled 60 to the primary chiller 50 significantly reduces the start-up, or amperage, draw of the primary chiller 50. The main chiller 50 stars a primary condenser pump 54 once the primary chiller 50 receives the conditioned fluid of secondary chiller 60, which results in starting the primary chiller 50 in reduced initial start-up or limited amperage setting. Once the temperature of the outside space sensor 134 drops below the set point to start the primary chiller 50, the process may reverse the start-up of primary chiller 50 and follow the reversal of the start-up procedures.

Referring to FIG. 7 again, the heat exchanger pump 44 is switched off and the utilized conditioned fluid is directed through the loop 98 bypassing the summer winter valve 90 and the heat return 3-way valve 96 to either of the closed loop pumps 80. The flow of utilized conditioned fluid flowing through the closed loop pump 80 is regulated such that the outside space sensor 136 enables the variable speed drive 82 of the close loop pump 80 for regulating the flow of the utilized conditioned fluid in the return line 12. From the closed loop pump 80 the return line 12 delivers the utilized conditioned fluid to the secondary chiller 60 as the summer winter valve 96 is closed. The close summer winter valve 96 directs the utilized conditioned fluid to the secondary chiller pump 62, which allows the utilized conditioned fluid to enter into the secondary chiller 60. The utilized conditioned fluid is conditioned in the small chiller 60, and sent to the primary boiler 50 with the closed secondary chiller bypass valve 66. The closed secondary chiller bypass valve 66 stops the flow of the conditioned fluid from the secondary chiller 60 to the supply line 10. The secondary chiller 60 conditions the utilized conditioned fluid of the return line 12 by dissipating the heat to the cooling tower 70. The cooling tower 70 operates in the similar manner for the secondary chiller 60, when the automatic switching two pipe hydronic system 500 operates in second part load condition. Once the primary chiller 50 receives the conditioned fluid from the secondary chiller 60, the main condenser pump 54 starts operating. The main condenser pump 54 pumps the cold water from the cooling tower 70 to the primary chiller 70 such that the heat of the conditioned fluid of the secondary chiller 50 is carried away by the water moving through the primary chiller 50 to the cooling tower 70. The water carrying the heat of the primary chiller 50, the heat of the conditioned fluid of the secondary chiller 60, is directed to the cooling tower 70 with the close cooling tower bypass valve 72. The close cooling tower bypass valve 72 directs the water through the pan disposed on the top of the cooling tower 70, which adds the cooling ability of the cooling tower system to the cooling tower 70. The cooling tower 70 is equipped with a fan 102 which is coupled to the variable speed drive for regulating the speed of the fan 102. The speed of the fan 102 is related to the temperature of the water leaving from the cooling tower 70 and entering the primary chiller 50. The drive of the fan 102 is programmed to produce the maximum chiller efficiency on direction of the primary chiller 50. In this case, when there is further increase in the temperature of the water flowing to the cooling tower 70, the variable speed drive of the fan 102 increase the speed of the fan 102, for increasing the efficiency of the primary chiller 60. The primary chiller 50 continue to operates till the temperature of the main heating sensor 120 senses temperature of 78° F. and more. The secondary chiller 60 should provide a conditioned fluid of 55° F. once the automatic switching two pipe hydronic system 500 operates in second full load condition. If the temperature of the outside space sensor 134 drops below the set point to start the primary chiller 50, the set point of 78° F., the process may reverse the start-up of primary chiller 50 and follow the reversal of the start-up procedures.

Figure 8:
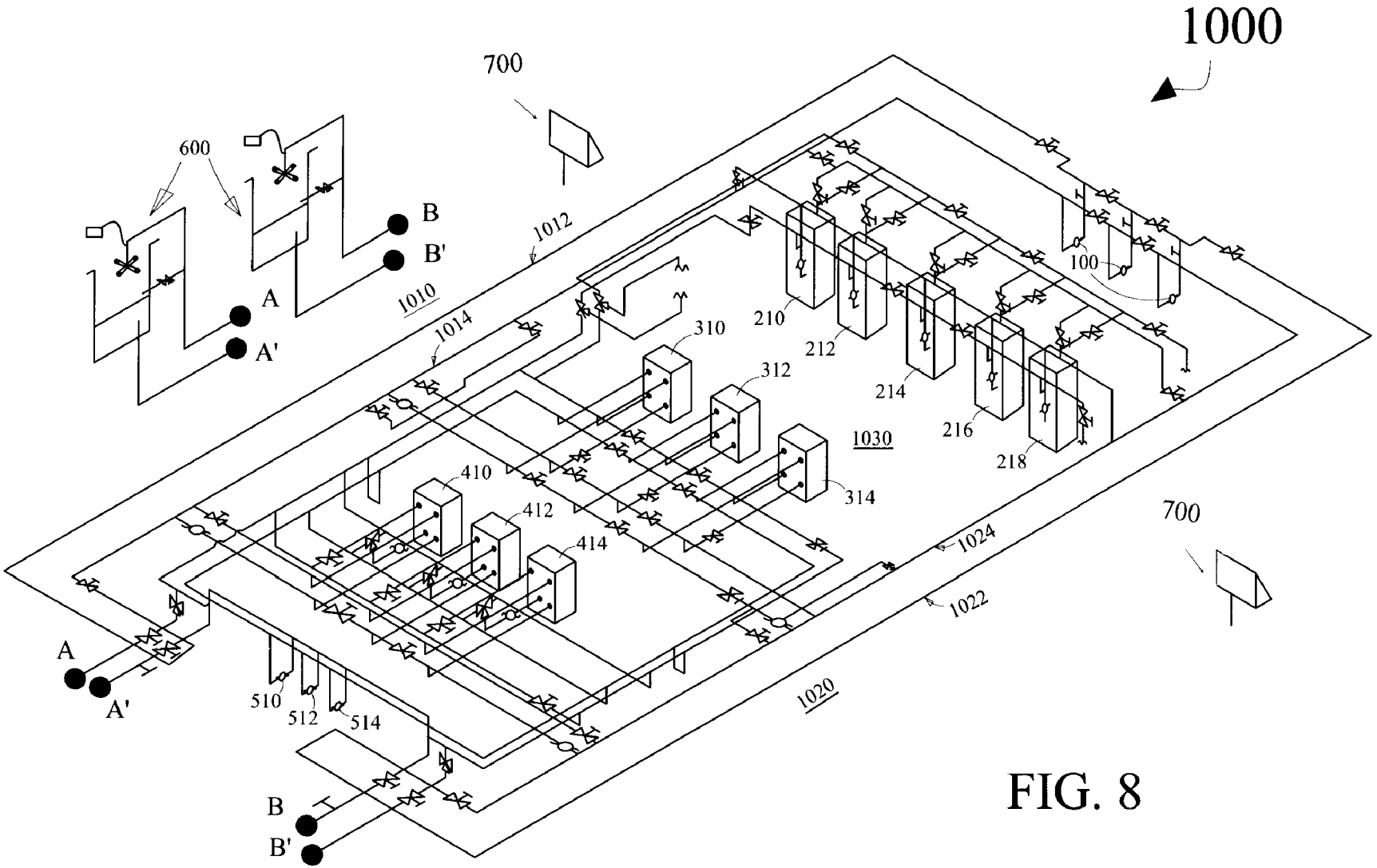
FIG. 8 is a schematic line diagram of an automatic switching two pipe hydronic system 1000 for simultaneously heating and cooling different portions of a space, according to another exemplary embodiment of the present invention.

In another embodiment, the present invention provides an automatic switching two pipe hydronic system for simultaneously heating and cooling different portions of a space. More specifically, now referring to FIG. 8, illustrated is an automatic switching two pipe hydronic system 1000 (herein after referred to as system 1000) for simultaneously heating and cooling a first portion 1010 and a second portion 1020 of a space 1030. As used herein, 'space' refers to a building space that needs to be air-conditioned depending upon the requirement on different portions of the building. In an exemplary situation, a scenario is considered wherein the system 1000 is configured to provide heating to a first portion 1010 (for example, a north side of a building not receiving proper sunlight in northern hemisphere winters) and the cooling to a second portion 1020 (for example, a south side of the building receiving proper sunlight in the northern hemisphere). The present invention is designed to be particularly effective with buildings having exposures such as East-West and North-South exposures. Other suitable exposures include, but are not limited to, West, North, North through North, East, North opposing East, East, South through Southwest, and South. Furthermore, other exposures may include North, East, East through East, Southeast opposing South, West, West to West-northwest. The invention is readily configurable to a building's particular solar exposure, depending on whether the building is situated in the northern or southern hemisphere. The architectural features of a building may be slightly modified or designed to enhance the adoption of the technology for increasing or decreasing solar exposure.

The system 1000 comprises a first flow path disposed towards the first portion 1010, the first flow path including a first supply line 1012 and a first return line 1014; a second flow path disposed towards the second portion 1020, the second flow path including a second supply line 1022 and a second return line 1024. Both the first flow path and the second flow path are capable of circulating a conditioned fluid for heating and cooling the space 1030 and receiving a utilized conditioned fluid from the space 1030 for re-conditioning the utilized conditioned fluid to the conditioned fluid. The system 1000 further comprises a plurality of closed loop pumps 100; a plurality of boilers 210, 212, 214, 216 and 218 disposed between the first flow path and the second flow path; a plurality of chillers 310, 312 and 314 disposed between the first flow path and the second flow path; a plurality of heat exchangers 410, 412 and 414 disposed between the first flow path and the second flow path; a plurality of condenser pumps 510, 512, and 514 disposed between the first flow path and the second flow path; a plurality of boiler flow control valves 250 coupled to the plurality of boilers 210, 212, 214, 216 and 218; a plurality of chiller flow control valves 350 coupled to the plurality of chillers 310, 312 and 314; a plurality of heart exchanger flow control valves 450 coupled to the plurality of heat exchangers 410, 412, 414; a plurality of sensors 700 for sensing an outside space temperature, a temperature of the first portion 1010 and the second portion 1020 within the space 1030 and temperatures of the conditioned fluid and utilized conditioned fluid in the first flow path and the second path; and a controlling module configured to acquire temperatures from the plurality of sensors 700 and capable of controlling the flow of conditioned fluid and utilized conditioned fluid through the boiler, chiller, and heat exchanger flow control valves 250, 350 and 450.

The supply lines 1012 and 1022 are configured to supply a conditioned fluid to the space 1030 and the return lines 1014 and 1024 are configured to return utilized conditioned fluid from the space 1030. The plurality of closed loop pumps are capable of circulating the conditioned fluid and the utilized conditioned fluid between the supply line 1012 and return line 1014 of the first flow path and between the supply line 1022 and return line 1024 of the second flow path. The plurality of boilers 210, 212, 214, 216 and 218 are capable of providing conditioned fluid to the first supply line 1012 and the second supply line 1022. The boilers 210, 212, 214, 216 and 218 generally have a dual function to perform, one being utilized for heating and the other for meeting the demand for domestic hot water supply. Very high efficiency boilers have small amounts of boiler water, operate at temperatures that vary from 70° F. to 180° F. and have stainless steel components for heat transfer, permitting direct contact with municipal water.

The heat exchangers 410, 412, and 414 are capable of receiving utilized conditioned fluid from the first return line 1014 and the second return line 1024, for reducing the temperature of the utilized conditioned fluid in the first return line 1014 and the second return line 1024 to be supplied as the conditioned fluid to the first supply line 1012 and the second supply line 1022 by transferring heat of the utilized conditioned fluid to a cooling tower fluid. The chillers 310, 312, and 314 are capable of receiving utilized conditioned fluid from the first return line 1014 and the second return line 1024, for reducing the temperature of the utilized conditioned fluid in the first return line 1014 and the second return line 1024 to be supplied as the conditioned fluid to the first supply line 1012 and the second supply line 1022 by transferring heat of the utilized conditioned fluid to the cooling tower fluid. The condenser pumps 510, 512, and 514 are capable of circulating the cooling tower fluid between a cooling tower 600 and the plurality of heat exchangers 410, 412, and 414 and the plurality of chillers 310, 312, and 314. The boiler flow control valves 250 are capable of controlling the flow of utilized conditioned fluid to the plurality of boilers 210, 212, 214, 216, and 218 from the first return line 1014 and the second return line 1024 and conditioned fluid from the plurality of boilers 210, 212, 214, 216, and 218 to the first supply line 1012 and the second supply line 1022. The plurality of chiller flow control valves 350 are capable of controlling the flow of utilized conditioned fluid to the chillers 310, 312, and 314 from the first return line 1014 and the second return line 1024 and conditioned fluid from the chillers 310, 312, and 314 to the first supply line 1012 and the second supply line 1022. The heat exchanger flow control valves 450 are capable of controlling the flow of utilized conditioned fluid to the heat exchangers 410, 412, and 414 from the first return line 1014 and the second return line 1024 and conditioned fluid from the heat exchangers 410, 412, and 414 to the first supply line 1012 and the second supply line 1022. The controlling module is configured to operate the boiler flow control valves 250, the chiller flow control valves 350 and the heat exchanger flow control valves 450 in a manner such that at least one boiler from the plurality of boilers 210, 212, 214, 216, and 218 and at least one chiller from the plurality of chillers 310, 312, and 3214 or at least one heat exchanger 410, 412, and 414 from the plurality of heat exchangers 410, 412, and 414 are capable of heating or cooling the first portion 1010 and the second portion 1020 simultaneously.

Figure 9:
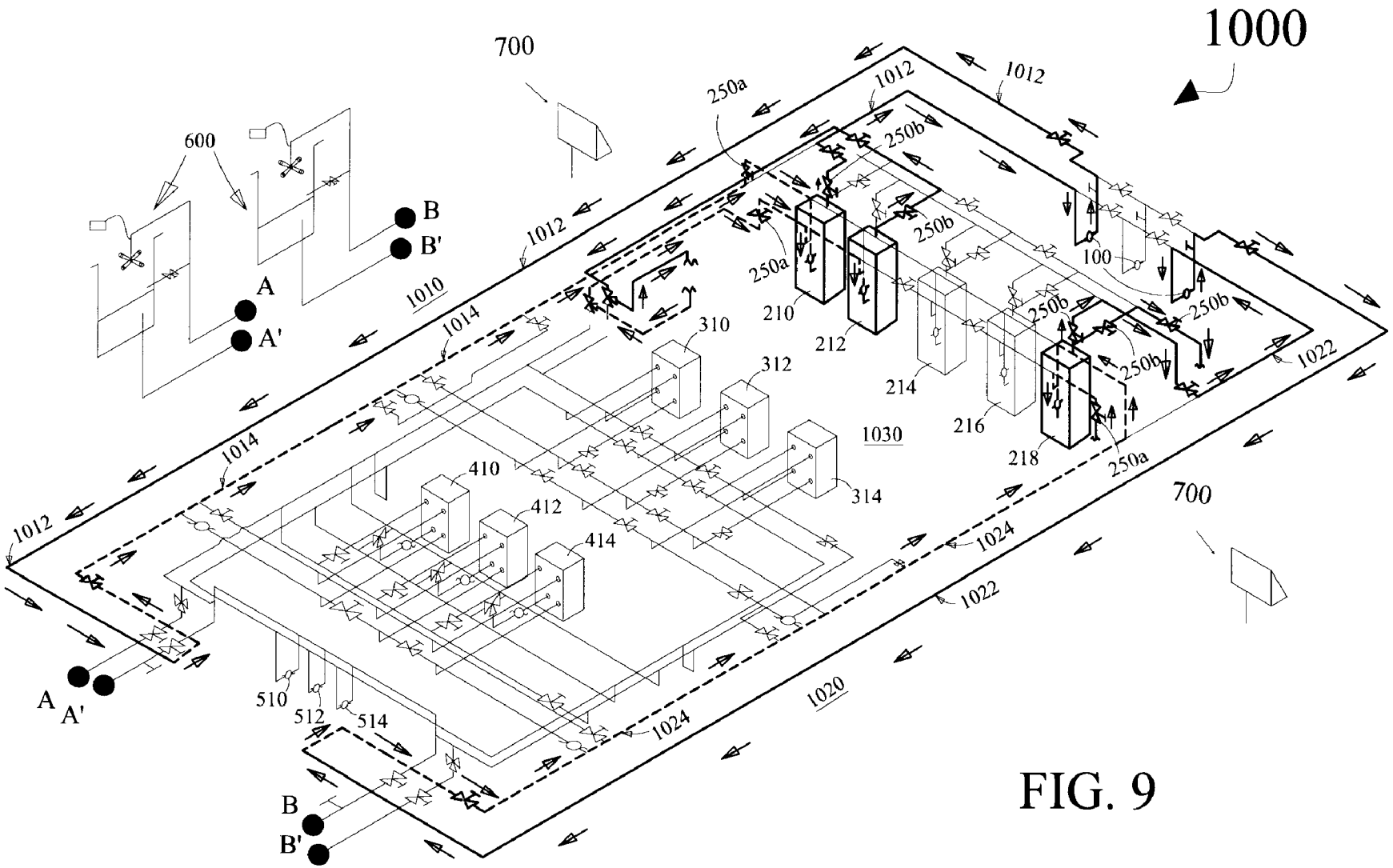
FIG. 9 is a schematic line diagram of the automatic switching two pipe hydronic system 1000, illustrating boilers 210 and 212 heating a first portion 1010 of a space 1030 and a boiler 218 heating a second portion 1020 of the space, according to another exemplary embodiment of the present invention.

Now, referring to FIG. 9, illustrated is a schematic line diagram of the system 1000, wherein at least one boiler from the plurality of boilers 210, 212, 214, 216, and 218 is individually heating a first portion 1010 of the space 1030 and providing domestic heat water and a second boiler from the plurality of boilers 210, 212, 214, 216, and 218 provides both heating and domestic heat water to the second portion 1020 of the space 1030. More particularly, for the first portion 1010, the boiler 210 receives the utilized conditioned fluid from the first return line 1014 for supplying conditioned fluid to the space 1030 through the supply line 1012. Similarly, the boiler 212 is capable of receiving the utilized domestic hot water from the space 1030 for supplying conditioned domestic hot water to the first portion of the space 1030. Towards the second portion 1020 of the space 1030, the boiler 218 receives the utilized conditioned fluid from the second return line 1024 for supplying conditioned fluid to the space 1030 through the supply line 1022. The boilers 210, 212, 214, 216, and 218 have a common outlet and a common inlet. Both inlets and outlets are equipped with a boiler flow control valve 250*a* and 250*b* respectively. The boiler flow control valve 250*a* is configured to receive the utilized conditioned fluid and utilized domestic hot water from the space 1030 and the boiler flow control valve 250*b* is configured to circulate conditioned fluid and the domestic hot water supply to the space 1030. The boiler flow control valves 250*a* and 250*b* can modulate from fully closed to fully open situation, thereby permitting the boilers 210, 212, 214, 216, and 218 to generate domestic hot water and space heat simultaneously. A typical domestic hot water load occurs three times daily. The morning and evening peak loads are fairly consistent. The controlling module, for instance, a Building Automation System (BAS) is equipped to use real time controls, and recognize the history of domestic hot water (DHW) use. This allows boiler water temperature to be reset higher during peak domestic hot water loads, and to minimize stand-by losses or the need to bring on an additional boiler. The controlling module will identify the heating load and the domestic hot water load from an aquastat located in the bottom ⅓ of DHW storage tanks (not shown). The building load for space heating will be determined by the outside air temperature (OSA) and indoor air temperature network, as well as solar load sensors positioned outside the building.

The domestic hot water load will always have priority over space heating load. In the event that the domestic hot water load and the space heating load cannot be met with one boiler, the controlling module will start the second boiler based on temperature of a storage tank sensor. The controlling module will determine when the space heating load will be required by set points of the OSA temperature reset schedule. Each particular building and climate will dictate this schedule. During non-heating seasons inlet cross line valves (not shown) may be shut down to avoid any flow but check valves on the space heat return or inlet lines will significantly reduce this effect. Furthermore, the controlling module will close the space heating flow control valve 250*a* and the flow will only be directed to the domestic hot water load. The boiler control valves disposed between the first return line 1014 and the inlet to the plurality of boilers 210, 212, 214, 216, and 218 control and coordinate the flow between the space heating and the domestic hot water heating. Thus the utilization of the system 1000 serves the purpose of meeting different requirements along to different portions of the space 1030 simultaneously. In one embodiment, the inputs of the plurality of boilers 210, 212, 214, 216, and 218 may vary from 300,000 Btu to over 1,500,000 Btu. The present invention utilizes modular design and piping of these boilers which are also fully modulating, firing 15% to 100% of input. This allows an effective matching of firing operation to the boiler load.

Figure 10:
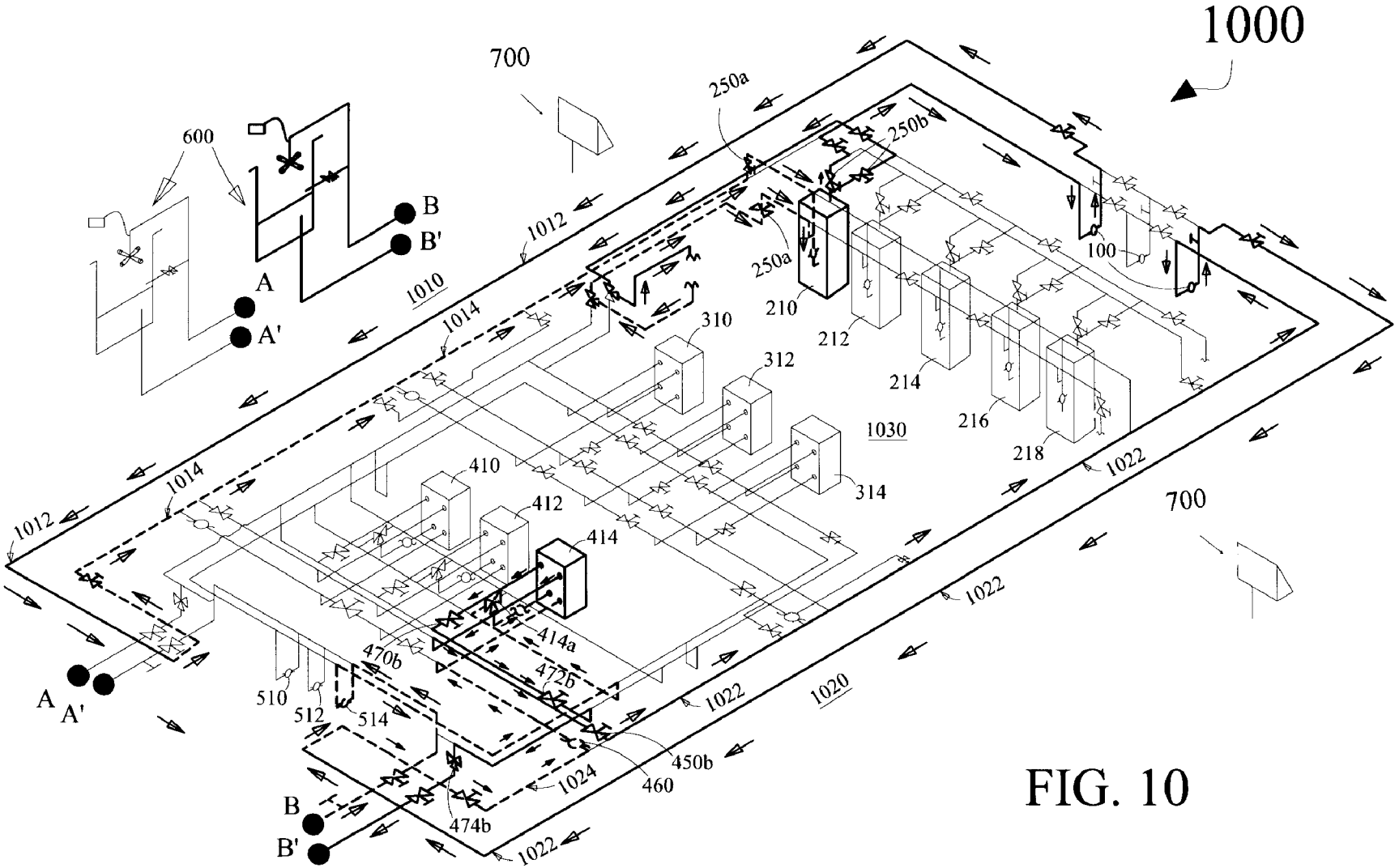
FIG. 10 is a schematic line diagram of the automatic switching two pipe hydronic system 1000, illustrating the boiler 210 heating the first portion 1010 of the space 1030 and a heat exchanger 414 cooling the second portion 1020 of the space 1030, according to another exemplary embodiment of the present invention.

Now, referring to FIG. 10, illustrated is a schematic line diagram of the system 1000, wherein one boiler from the plurality of boilers 210, 212, 214, 216, and 218 is heating a first portion 1010 of the space 1030 and also providing domestic heat water to the first portion 1010 and cooling a second portion using a heat exchanger 414. Upon determining the requirement of heating the first portion 1010 by the controlling module, the boiler 210 is fired and the boiler 210 receives the utilized conditioned fluid from the first return line 1014 for supplying conditioned fluid to the space 1030 through the supply line 1012. Further, the boiler 210 receives utilized domestic heat water from the space 1030 and provides conditioned domestic hot water to the space 1030. The boiler 210 has a common outlet and a common inlet. Both inlets and outlets are equipped with a boiler flow control valves 250*a* and 250*b* respectively. The boiler flow control valve 250*a* is configured to receive the utilized conditioned fluid and utilized domestic hot water from the space 1030 and the boiler flow control valve 250*b* is configured to circulate conditioned fluid and the conditioned domestic hot water supply to the space 1030. The boiler flow control valves 250*a* and 250*b* can modulate, from fully closed to fully open situation, thereby permitting the boiler 210 to generate domestic hot water and space heat simultaneously. Now, towards the second portion 1020 of the space 1030, the heat exchanger 414 receives the utilized conditioned fluid from the second return line 1024 for supplying conditioned fluid to the space 1030 through the supply line 1022. The controlling module opens a valve of a heat exchanger pump 460 disposed on an inlet cross line for permitting the use of the utilized conditioned fluid into the heat exchanger 414. Further, a heat exchanger flow control valve 450*b* is disposed on the outlet of heat exchanger 414 for controlling the flow from the heat exchanger 414. The utilized conditioned fluid from the second return line 1024 is cooled down in the heat exchanger 414 by dissipating the heat of the utilized conditioned fluid to a circulating cooling tower fluid from the cooling tower 600. The circulating cooling tower fluid from the cooling tower 600 passes through the condenser pump 514 and enters into the heat exchanger 414 via a three way valve 414*a*. The circulating cooling tower fluid carrying the heat from the heat exchanger 414 passes through a plurality of valves 470*b*, 472*b*, and 474*b* to the cooling tower 600. The conditioned fluid from the heat exchanger 414 is delivered to the supply line 1022 through the automatic flow control valve 450*b*.

Figure 11:
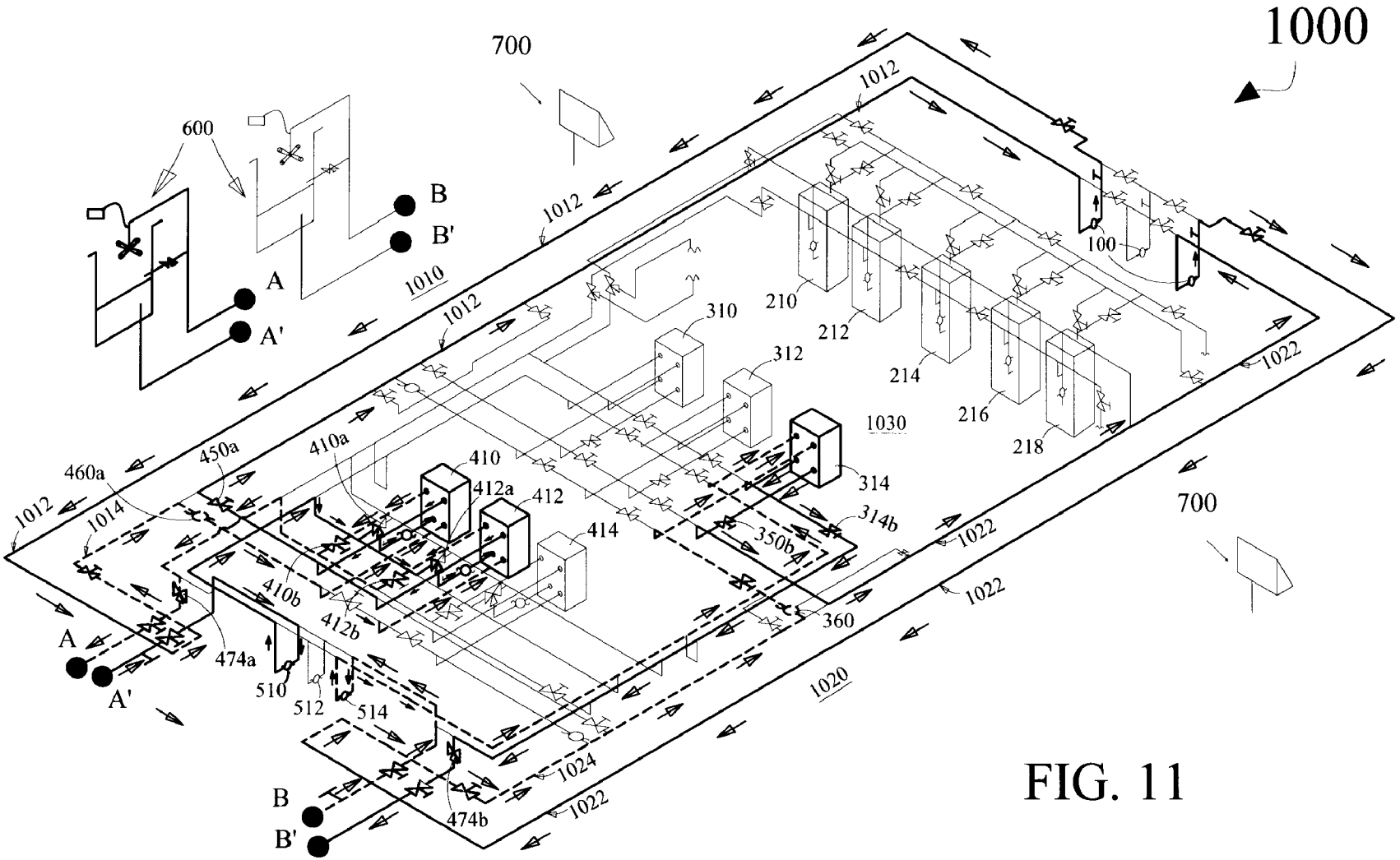
FIG. 11 is a schematic line diagram of the automatic switching two pipe hydronic system 1000, illustrating heat exchangers 410 and 412 moderately heating the first portion 1010 of the space 1030 and a chiller 314 cooling the second portion 1020 of the space 1030, according to another exemplary embodiment of the present invention.

FIG. 11 refers to another embodiment of the present invention, illustrating a schematic line diagram of the system 1000, wherein the first portion 1010 of the space 1030 needs to be moderately heated and the second portion 1020 of the space 1030 needs to be air-conditioned (i.e., cooled.) The system 1000 uses two heat exchangers 410 and 412 from the plurality of heat exchangers 410, 412, and 414 for moderately heating the first portion 1010 of the space 1030 and uses the chiller 314 from the plurality of chillers, 310, 312, and 314 for cooling the second portion 1020 of the space 1030.

Now, towards the first portion 1020 of the space 1030, the heat exchanger 410 and 412 receives the utilized conditioned fluid from the first return line 1014 for supplying conditioned fluid to the space 1030 through the first supply line 1012. The controlling module opens a valve of a heat exchanger pump 460*a* disposed on an inlet cross line for permitting the use of the utilized conditioned fluid into the heat exchangers 410 and 412. Further, a heat exchanger flow control valve 450*a* is disposed on the outlet of heat exchangers 410, 412 for controlling the flow from the heat exchangers 410, 412. The utilized conditioned fluid from the first return line 1014 is cooled down in the heat exchangers 410 and 412 by dissipating the heat of the utilized conditioned fluid to a circulating cooling tower fluid from the cooling tower 600. The circulating cooling tower fluid from the cooling tower 600 passes through the condenser pump 510 and enters into the heat exchangers 410, 412 via three way valves 410*a* and 412*a*. The circulating cooling tower fluid carrying the heat from the heat exchangers 410, 412 passes through a plurality of valves 410*b*, 474*a* of the heat exchanger 410 and through valves 412*b*, 474*a* of heat exchanger 412, to the cooling tower 600. The conditioned fluid from the heat exchanger 410 and 412 is delivered to the supply line 1012 through the automatic flow control valve 450*a*.

Now towards the second portion 1020 of the space 1030, the chiller 314 receives the utilized conditioned fluid from the second return line 1024 for supplying conditioned fluid to the space 1030 through the second supply line 1022. The controlling module opens a valve of a chiller pump 360 disposed on an inlet cross line for permitting the use of the utilized conditioned fluid into the chiller 314. Further, a heat exchanger flow control valve 350*b* is disposed on the outlet of the chiller 314 for controlling the flow from the chiller 314. The utilized conditioned fluid from the second return line 1024 is cooled down in the chiller 314 by dissipating the heat of the utilized conditioned fluid to a circulating cooling tower fluid from the cooling tower 600. The circulating cooling tower fluid from the cooling tower 600 passes through the condenser pump 514 and enters into the chiller 314. The circulating cooling tower fluid carrying the heat from the chiller 314 passes through a plurality of valves 314*b*, and 474*b* to the cooling tower 600. The conditioned fluid from the chiller 314 is delivered to the supply line 1022 through the automatic flow control valve 350*b*.

Figure 12:
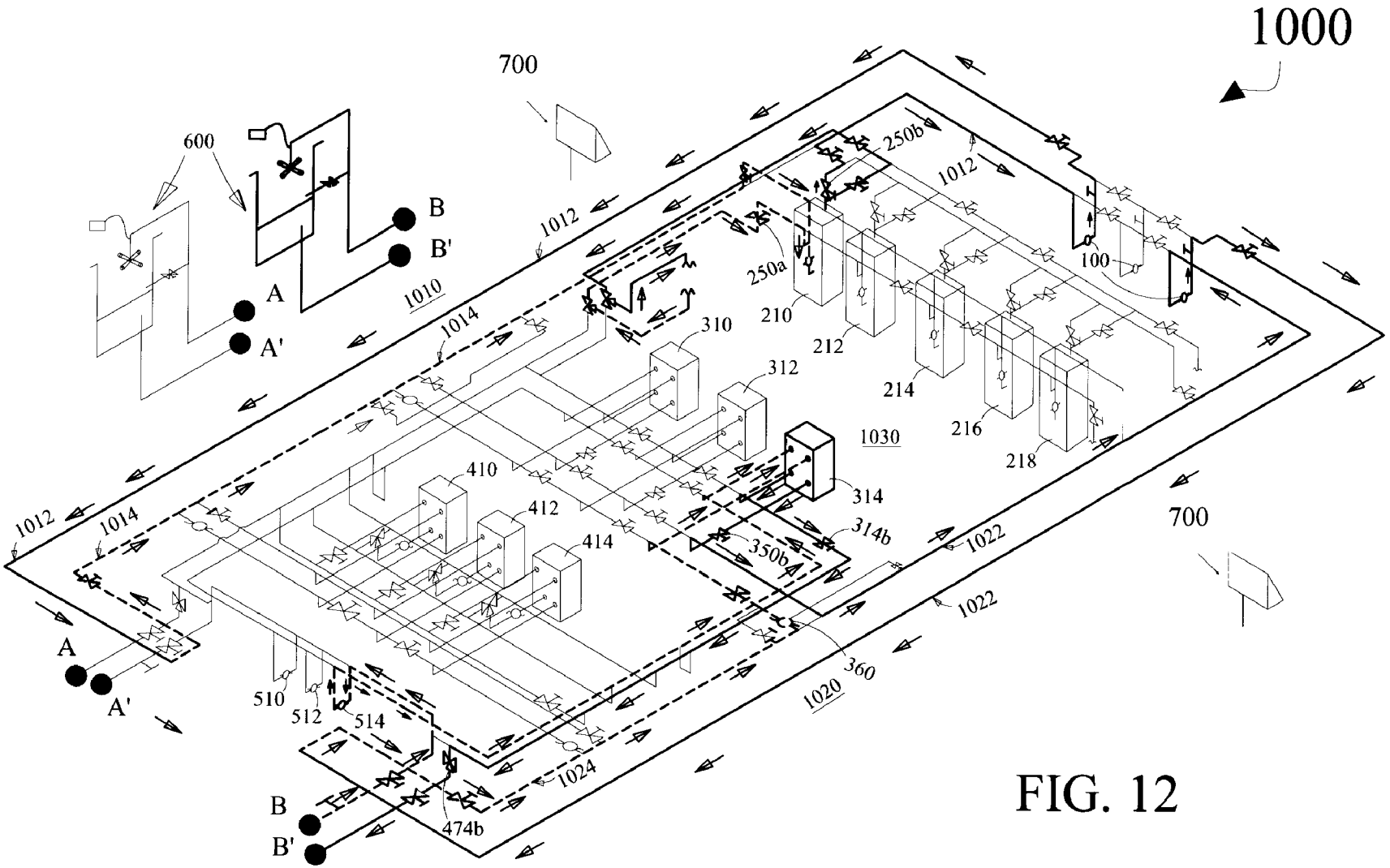
FIG. 12 is a schematic line diagram of the automatic switching two pipe hydronic system 1000, illustrating the boiler 210 heating the first portion 1010 of the space 1030 and the chiller 314 cooling the second portion 1020 of the space 1030, according to another exemplary embodiment of the present invention.

Now, referring to FIG. 12, illustrated is a schematic line diagram of the system 1000, wherein one boiler from the plurality of boilers 210, 212, 214, 216, and 218 is heating a first portion 1010 of the space 1030 and also providing domestic heat water to the first portion 1010 and cooling a second portion using a chiller 314. Upon determining the requirement of heating the first portion 1010 by the controlling module, the boiler 210 is fired and the boiler 210 receives the utilized conditioned fluid from the first return line 1014 for supplying conditioned fluid to the space 1030 through the supply line 1012. Further, the boiler 210 receives utilized domestic heat water from the space 1030 and provides conditioned domestic hot water to the space 1030. The boiler 210 has a common outlet and a common inlet. Both inlets and outlets are equipped with a boiler flow control valves 250*a* and 250*b* respectively. The boiler flow control valves 250*a* is configured to receive the utilized conditioned fluid and utilized domestic hot water from the space 1030 and the boiler flow control valves 250*b* is configured to circulate conditioned fluid and the conditioned domestic hot water supply to the space 1030. The boiler flow control valves 250*a* and 250*b* can modulate, from fully closed to fully open situation, thereby permitting the boiler 210 to generate domestic hot water and space heat simultaneously.

Now towards the second portion 1020 of the space 1030, the chiller 314 receives the utilized conditioned fluid from the second return line 1024 for supplying conditioned fluid to the space 1030 through the second supply line 1022. The controlling module opens a valve of a chiller pump 360 disposed on an inlet cross line for permitting the use of the utilized conditioned fluid into the chiller 314. Further, a chiller flow control valve 350*b* is disposed on the outlet of the chiller 314 for controlling the flow from the chiller 314. The utilized conditioned fluid from the second return line 1024 is cooled down in the chiller 314 by dissipating the heat of the utilized conditioned fluid to a circulating cooling tower fluid from the cooling tower 600. The circulating cooling tower fluid from the cooling tower 600 passes through the condenser pump 514 and enters into the chiller 314. The circulating cooling tower fluid carrying the heat from the chiller 314 passes through a plurality of valves 314*b*, and 474*b* to the cooling tower 600. The conditioned fluid from the chiller 314 is delivered to the supply line 1022 through the automatic flow control valve 350*b*.

Figure 13:
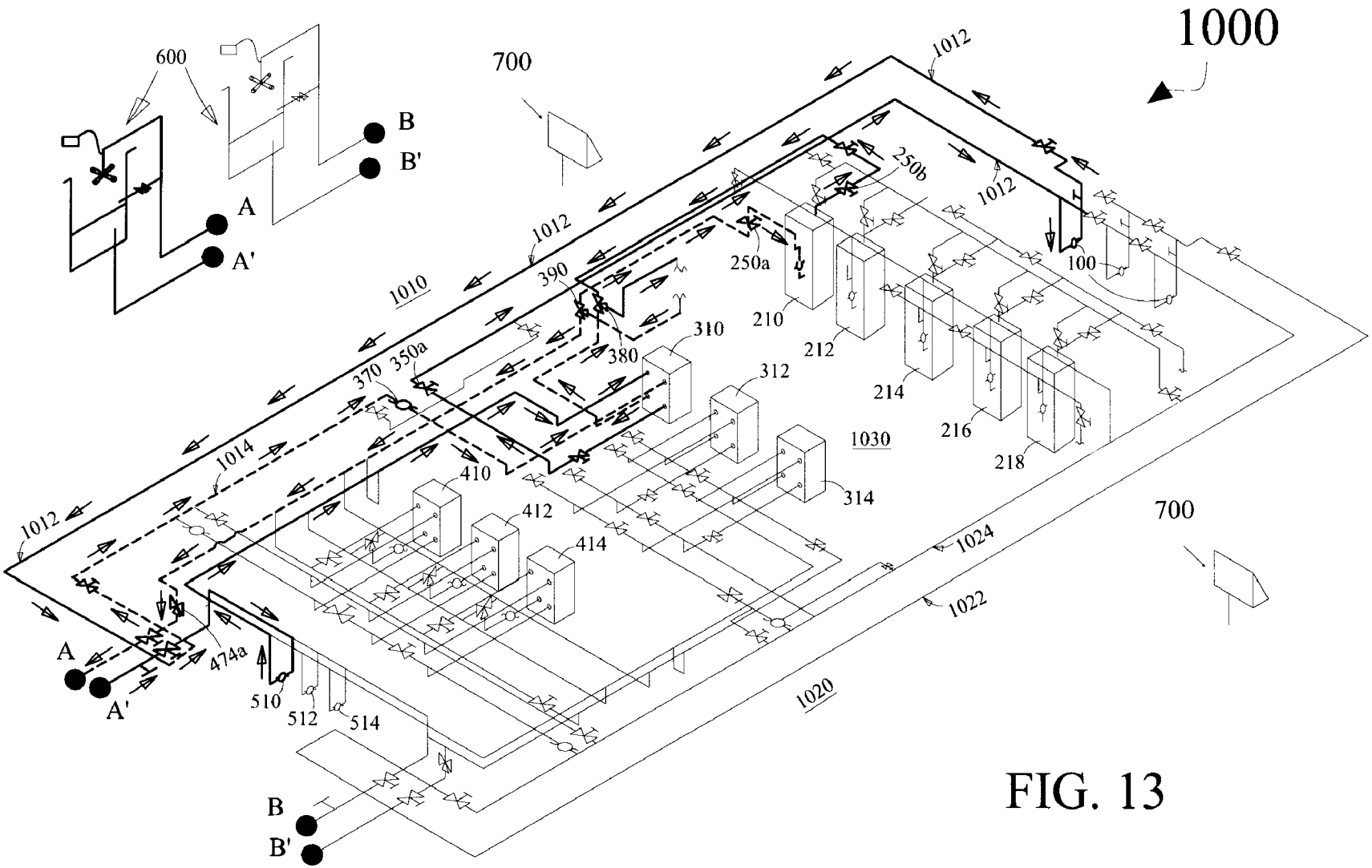
FIG. 13 is a schematic line diagram of the automatic switching two pipe hydronic system 1000 illustrating the need for cooling the first portion 1010 and providing domestic hot water by utilizing the rejected heat of the chiller 310, according to another exemplary embodiment of the present invention.

FIG. 13 is a schematic line diagram of the system 1000 illustrating the need for cooling the first portion 1010 and providing domestic hot water by utilizing the rejected heat of the chiller 310. In this embodiment, upon detection by the controlling module, the requirement of cooling the first portion 1010 of the space 1030, the controlling module opens a valve of the chiller pump 370 disposed on an inlet cross line for permitting the use of the utilized conditioned fluid into the chiller 310. Further, a chiller flow control valve 350*a* is disposed on the outlet of the chiller 310 for controlling the flow from the chiller 310. The utilized conditioned fluid from the first return line 1014 is cooled down in the chiller 310 by dissipating the heat of the utilized conditioned fluid to a circulating cooling tower fluid from the cooling tower 600. The conditioned fluid from the chiller 310 is supplied to the supply line 1012 through the chiller flow control valve 350*a* and the closed loop pump 100 to the first portion 1010. The circulating cooling tower fluid from the cooling tower 600 passes through the condenser pump 510 and enters into the chiller 310. The circulating cooling tower fluid carrying the heat from the chiller 310 passes through a domestic hot water heat exchanger three way valve 380 and may be supplied as domestic hot water supply. The conditioned fluid from the boiler 210 is delivered as domestic hot water through the domestic hot water heat exchanger three way valve 380. The utilized domestic hot water from the first portion 1010 is delivered as to the cooling tower 600 through the domestic hot water heat exchanger three way valve 390. Furthermore, the utilized domestic hot water from the first portion 1010 is delivered as supply to the boiler 210 through the domestic hot water heat exchanger three way valve 390. Thereby the system 1000 enables utilization of the rejected heat of the chiller 310 to be utilized for the boiler 210 as well as to domestic hot water supply.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is understood that various omissions, substitutions, and equivalents are contemplated as circumstances may suggest or render expedient, but it is intended to cover the application or implementation without departing from the spirit or scope of the claims of the present invention.

What is claimed is:

1. An automatic switching two pipe hydronic system, comprising:

a supply line configured to supply a conditioned fluid to a space;

a return line configured to return utilized conditioned fluid from the space;

a primary boiler in fluid communication with the supply line and the return line, the primary boiler capable of operating in a first full load condition;

a secondary boiler in fluid communication with the supply line and the return line, the secondary boiler capable of operating in a first part load condition;

a heat exchanger in fluid communication with the supply line and the return line, the heat exchanger configured to transfer heat between the return line and the supply line;

a primary chiller in fluid communication with the supply line and the return line, the primary chiller capable of operating in a second full load condition;

a secondary chiller in fluid communication with the supply line and the return line, the secondary chiller capable of operating in a second part load condition;

a cooling tower in fluid communication with the heat exchanger, the primary chiller and the secondary chiller, the cooling tower configured to take away heat from the heat exchanger, the primary chiller and the secondary chiller;

at least one closed loop pump having a variable speed drive, the closed loop pump capable of regulating the flow between the return line and the supply line;

a plurality of flow controls valves disposed in the supply line and the return line, the flow controls capable of controlling the flow of fluid through the supply and return line and the primary boiler, the secondary boiler, the heat exchanger, the primary chiller, the secondary chiller, and the cooling tower;

a plurality of sensors for sensing an outside space temperature, an inside space temperature, and temperature of the fluid in the supply line and the return line;

a bypass pipe and automatic flow control valve entering the cooling tower below a cooling tower fluid distribution pan; and a controlling module configured to acquire temperatures from the plurality of sensors and capable of controlling the flow of fluid through the flow control valves.

2. The automatic switching two pipe hydronic system of claim 1, wherein the automatic switching two pipe hydronic system enables switching from a first mode of operation to a second mode of operation in about 4 hours.

3. The automatic switching two pipe hydronic system of claim 2, wherein the first mode of operation is heating and second mode of operation is cooling and vice-versa.

4. The automatic switching two pipe hydronic system of claim 1, wherein the cooling tower comprises a cooling tower bypass valve capable of diverting an incoming cooling tower circulating fluid to a sump instead of flowing into the cooling tower fluid distribution pan.

5. The automatic switching two pipe hydronic system of claim 1, wherein the plurality of sensors include inside space sensors and outside space sensors.

6. The automatic switching two pipe hydronic system of claim 5, wherein the inside space sensors and the outside space sensors have a differential of two degrees.

* * * * *